US010166763B2

(12) United States Patent
Honda et al.

(10) Patent No.: US 10,166,763 B2
(45) Date of Patent: Jan. 1, 2019

(54) PRINTING APPARATUS, PRINTING METHOD AND STORAGE MEDIUM

(71) Applicant: CANON KABUSHIKI KAISHA, Tokyo (JP)

(72) Inventors: Yoshiyuki Honda, Yokohama (JP); Hitoshi Nishikori, Inagi (JP); Atsuhiko Masuyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 89 days.

(21) Appl. No.: 15/307,792

(22) PCT Filed: Jun. 17, 2015

(86) PCT No.: PCT/JP2015/003043
§ 371 (c)(1),
(2) Date: Oct. 28, 2016

(87) PCT Pub. No.: WO2015/194177
PCT Pub. Date: Dec. 23, 2015

(65) Prior Publication Data

US 2017/0050434 A1 Feb. 23, 2017

(30) Foreign Application Priority Data

Jun. 18, 2014 (JP) ..... 2014-125509

(51) Int. Cl.
*B41J 2/01* (2006.01)
*B41J 2/04* (2006.01)
*B41J 2/045* (2006.01)

(52) U.S. Cl.
CPC ..... *B41J 2/04573* (2013.01); *B41J 2/04543* (2013.01); *B41J 2/04585* (2013.01)

(58) Field of Classification Search
CPC .... B41J 2/04543; B41J 2/2135; B41J 2/2132; B41J 19/145; B41J 2/04545;
(Continued)

(56) References Cited

U.S. PATENT DOCUMENTS 5,280,310 A 1/1994 Otsuka et al. ..... 347/12
5,481,281 A 1/1996 Otsuka et al. ..... 347/12
(Continued)

FOREIGN PATENT DOCUMENTS

JP 2006-334899 * 12/2006 ..... B41J 2/05
JP 2012-040806 * 3/2012 ..... B41J 2/355
(Continued)

OTHER PUBLICATIONS

Machine-generated translation of JP 2006-334899, published on Dec. 2006.*
(Continued)

*Primary Examiner* — Huan Tran
(74) *Attorney, Agent, or Firm* — Venable, LLP

(57) ABSTRACT

A printing apparatus having a plurality of print element arrays including a plurality of printing elements that are time-share driven achieves both improvement of quality at an image edge, and maintenance of uniformity with respect to inclination error between print element arrays. In a case where the plurality of printing elements of the print element array that discharges ink having the highest density are driven, and dots of image data in the array direction of the printing elements are printed so that the dots are arranged along a specified line in the array direction of the printing elements. Whereas the plurality of printing elements of a different print element array are driven, and dots of the image data in the array direction of those printing elements are printed so that each dot is displaced by a displacement amount for the each dot with respect to the specified line.

27 Claims, 17 Drawing Sheets

(58) Field of Classification Search
CPC ..... B41J 2/04505; B41J 2/04585; B41J 2/04573; G06K 15/102; G06K 2215/111
See application file for complete search history.

(56) References Cited

U.S. PATENT DOCUMENTS

| | | | | |
|---|---|---|---|---|
| 5,880,751 | A | 3/1999 | Nishikori et al. | 347/14 |
| 5,943,073 | A | 8/1999 | Otsuka et al. | 347/48 |
| 6,024,430 | A | 2/2000 | Koitabashi et al. | 347/17 |
| 6,120,129 | A | 9/2000 | Iwasaki et al. | 347/43 |
| 6,142,600 | A | 11/2000 | Takahashi et al. | 347/23 |
| 6,145,950 | A | 11/2000 | Ohtsuka et al. | 347/15 |
| 6,149,259 | A | 11/2000 | Otsuka et al. | 347/12 |
| 6,158,836 | A | 12/2000 | Iwasaki et al. | 347/15 |
| 6,244,681 | B1 | 6/2001 | Yano et al. | 347/15 |
| 6,260,938 | B1 | 7/2001 | Ohtsuka et al. | 347/15 |
| 6,328,403 | B1 | 12/2001 | Iwasaki et al. | 347/15 |
| 6,352,327 | B1 | 3/2002 | Yano et al. | 347/14 |
| 6,371,592 | B1 | 4/2002 | Otsuka et al. | 347/19 |
| 6,390,586 | B1 | 5/2002 | Takahashi et al. | 347/19 |
| 6,543,872 | B2 | 4/2003 | Ohtsuka et al. | 347/19 |
| 6,601,938 | B1 | 8/2003 | Iwasaki et al. | 347/15 |
| 6,736,501 | B2 | 5/2004 | Yamaguchi et al. | 347/104 |
| 6,764,154 | B2 | 7/2004 | Nishikori et al. | 347/12 |
| 6,808,247 | B2 | 10/2004 | Kawatoko et al. | 347/23 |
| 6,877,833 | B2 | 4/2005 | Teshigawara et al. | 347/15 |
| 6,890,060 | B2 | 5/2005 | Yakura et al. | 347/41 |
| 6,899,413 | B2 | 5/2005 | Otsuka et al. | 347/40 |
| 6,935,737 | B2 | 8/2005 | Kanome et al. | 347/104 |
| 6,957,880 | B2 | 10/2005 | Kawatoko et al. | 347/14 |
| 6,991,316 | B2 | 1/2006 | Maru et al. | 347/41 |
| 7,011,391 | B2 | 3/2006 | Otsuka et al. | 347/43 |
| 7,057,756 | B2 | 6/2006 | Ogasahara et al. | 358/1.15 |
| 7,090,332 | B2 | 8/2006 | Konno et al. | 347/43 |
| 7,131,713 | B2 | 11/2006 | Otsuka et al. | 347/15 |
| 7,165,823 | B2 | 1/2007 | Yakura et al. | 347/12 |
| 7,192,112 | B2 | 3/2007 | Nakanishi et al. | 347/14 |
| 7,192,114 | B2 | 3/2007 | Suzuki et al. | 347/19 |
| 7,258,412 | B2 | 8/2007 | Maru et al. | 347/15 |
| 7,261,387 | B2 | 8/2007 | Nishikori et al. | 347/15 |
| 7,287,830 | B2 | 10/2007 | Ide et al. | 347/43 |
| 7,303,247 | B2 | 12/2007 | Maru et al. | 347/15 |
| 7,328,963 | B2 | 2/2008 | Tajika et al. | 347/19 |
| 7,354,133 | B2 | 4/2008 | Ide et al. | 347/23 |
| 7,404,612 | B2 | 7/2008 | Takamiya et al. | 347/11 |
| 7,408,676 | B2 | 8/2008 | Yazawa et al. | 358/1.9 |
| 7,455,379 | B2 | 11/2008 | Otsuka et al. | 347/15 |
| 7,515,318 | B2 | 4/2009 | Nishikori et al. | 358/520 |
| 7,533,962 | B2 | 5/2009 | Masuyama et al. | 347/41 |
| 7,537,310 | B2 | 5/2009 | Konno et al. | 347/43 |
| 7,537,661 | B2 | 5/2009 | Nakagawa et al. | 118/708 |
| 7,591,545 | B2 | 9/2009 | Iwasaki et al. | 347/84 |
| 7,614,714 | B2 | 11/2009 | Masuyama et al. | 347/16 |
| 7,651,194 | B2 | 1/2010 | Yazawa et al. | 347/36 |
| 7,669,989 | B2 | 3/2010 | Oshio et al. | 347/84 |
| 7,690,744 | B2 | 4/2010 | Nakanishi et al. | 347/12 |
| 7,699,430 | B2 | 4/2010 | Takamiya et al. | 347/19 |
| 7,722,143 | B2 | 5/2010 | Yoshikawa et al. | 347/7 |
| 7,802,865 | B2 | 9/2010 | Takamiya et al. | 347/11 |
| 7,819,497 | B2 | 10/2010 | Konno et al. | 347/19 |
| 7,850,273 | B2 | 12/2010 | Yasutani et al. | 347/16 |
| 7,862,149 | B2 | 1/2011 | Yasutani et al. | 347/43 |
| 7,891,796 | B2 | 2/2011 | Masuyama et al. | 347/93 |
| 7,901,022 | B2 | 3/2011 | Nakanishi et al. | 347/12 |
| 7,903,280 | B2 | 3/2011 | Yazawa et al. | 358/1.8 |
| 7,963,245 | B2 | 6/2011 | Oshio et al. | 118/679 |
| 7,980,672 | B2 | 7/2011 | Umezawa et al. | 347/55 |
| 8,001,921 | B2 | 8/2011 | Oshio et al. | 118/114 |
| 8,038,253 | B2 | 10/2011 | Ide et al. | 347/23 |
| 8,079,659 | B2 | 12/2011 | Tajika et al. | 347/16 |
| 8,164,789 | B2 | 4/2012 | Nishikori et al. | 358/1.9 |
| 8,184,342 | B2 * | 5/2012 | Hirosawa | B41J 2/2135 358/1.5 |
| 8,186,783 | B2 | 5/2012 | Yasutani et al. | 347/5 |
| 8,205,982 | B2 | 6/2012 | Masuyama et al. | 347/103 |
| 8,210,637 | B2 | 7/2012 | Masuyama et al. | 347/16 |
| 8,231,216 | B2 | 7/2012 | Yamamuro et al. | 347/104 |
| 8,251,473 | B2 | 8/2012 | Moriyama et al. | 347/14 |
| 8,251,479 | B2 | 8/2012 | Seki et al. | 347/16 |
| 8,251,482 | B1 | 8/2012 | Yasutani et al. | 347/16 |
| 8,287,074 | B2 | 10/2012 | Kano et al. | 347/15 |
| 8,430,472 | B2 | 4/2013 | Nishikori et al. | 347/15 |
| 8,439,472 | B2 | 5/2013 | Yasutani et al. | 347/14 |
| 8,511,779 | B2 | 8/2013 | Yasutani et al. | 347/15 |
| 8,511,787 | B2 | 8/2013 | Yasutani et al. | 347/19 |
| 8,517,490 | B2 * | 8/2013 | Kanematsu | B41J 2/2135 347/12 |
| 8,608,271 | B2 | 12/2013 | Murayama et al. | 347/15 |
| 8,651,614 | B2 | 2/2014 | Sakamoto et al. | 347/19 |
| 8,671,880 | B2 | 3/2014 | Oshio et al. | 118/712 |
| 8,727,526 | B2 | 5/2014 | Yamamoto et al. | 347/102 |
| 8,740,333 | B2 | 6/2014 | Teshigawara et al. | 347/12 |
| 8,814,296 | B2 * | 8/2014 | Yazawa | B41J 19/96 347/13 |
| 8,864,266 | B2 | 10/2014 | Suzuki et al. | 347/15 |
| RE45,265 | E | 12/2014 | Yano et al. | 347/43 |
| 8,931,875 | B2 | 1/2015 | Kosaka et al. | 347/17 |
| 8,944,584 | B2 | 2/2015 | Sakamoto et al. | 347/104 |
| 8,979,238 | B2 | 3/2015 | Nishikori et al. | 347/19 |
| 9,016,821 | B2 | 4/2015 | Masuda et al. | 347/15 |
| 9,108,403 | B2 | 8/2015 | Kawatoko et al. | B41J 2/07 |
| 9,174,436 | B2 | 11/2015 | Suzuki et al. | B41J 2/04541 |
| 9,409,390 | B1 | 8/2016 | Nishikori et al. | B41J 2/0458 |
| 2006/0158471 | A1 | 7/2006 | Jeong | 347/9 |
| 2006/0274097 | A1 * | 12/2006 | Fujimoto | B41J 2/04508 347/15 |
| 2009/0002415 | A1 * | 1/2009 | Teshigawara | B41J 2/2135 347/11 |
| 2009/0033702 | A1 | 2/2009 | Clark | 347/14 |
| 2012/0044291 | A1 * | 2/2012 | Kanematsu | B41J 2/2135 347/12 |
| 2012/0274951 | A1 | 11/2012 | Nishikori et al. | 358/1.2 |
| 2013/0088537 | A1 * | 4/2013 | Yazawa | B41J 19/96 347/9 |
| 2013/0201238 | A1 * | 8/2013 | Tanaka | B41J 2/04573 347/14 |
| 2016/0096364 | A1 | 4/2016 | Suzuki et al. | B41J 2/2139 |

FOREIGN PATENT DOCUMENTS

| | | | | |
|---|---|---|---|---|
| JP | 2013-159017 | * | 8/2013 | B41J 2/01 |
| WO | 2001/053102 | | 7/2001 | |

OTHER PUBLICATIONS

Machine-generated translation of JP 2012-040806, published on Mar. 2012.*

Machine-generated translation of JP 2013-159017, published on Aug. 2013.*

International Search Report dated Sep. 28, 2015 in counterpart International Application PCT/JP2015/003043.

International Preliminary Report on Patentability and Written Opinion dated Dec. 29, 2016 in counterpart International Application PCT/JP2015/003043.

* cited by examiner

PRINTING WITH PRINT HEADS HAVING NO INCLINATION ERROR

PRINTING WITH PRINT HEADS HAVING INCLINATION ERROR

PRINTING WITH PRINT HEADS THAT HAVE/DO NOT HAVE INCLINATION ERROR

| NOZZLE | DRIVE SEQUENCE I | SHIFTED AMOUNT OF NOZZLES CORRESPONDING TO DRIVE SEQUENCE I (μm) |
|---|---|---|
| 1 | 0 | 0 |
| 2 | 6 | 7.92 |
| 3 | 12 | 15.84 |
| 4 | 3 | 3.96 |
| 5 | 9 | 11.88 |
| 6 | 15 | 19.8 |
| 7 | 2 | 2.64 |
| 8 | 8 | 10.56 |
| 9 | 14 | 18.48 |
| 10 | 5 | 6.6 |
| 11 | 11 | 14.52 |
| 12 | 1 | 1.32 |
| 13 | 7 | 9.24 |
| 14 | 13 | 17.16 |
| 15 | 4 | 5.28 |
| 16 | 10 | 13.2 |

| NOZZLE | DRIVE SEQUENCE I | DRIVE SEQUENCE II CORRESPONDING TO DRIVE SEQUENCE I |
|---|---|---|
| 1 | 0 | 15 |
| 2 | 6 | 9 |
| 3 | 12 | 3 |
| 4 | 3 | 12 |
| 5 | 9 | 6 |
| 6 | 15 | 0 |
| 7 | 2 | 13 |
| 8 | 8 | 7 |
| 9 | 14 | 1 |
| 10 | 5 | 10 |
| 11 | 11 | 4 |
| 12 | 1 | 14 |
| 13 | 7 | 8 |
| 14 | 13 | 2 |
| 15 | 4 | 11 |
| 16 | 10 | 5 |

| NOZZLE | DRIVE SEQUENCE I | SHIFTED AMOUNT OF DOTS ON THE PRINT MEDIUM FOR A STRAIGHT LINE ARRANGEMENT (μm) | SHIFTED AMOUNT OF NOZZLES IN A SHIFTED NOZZLE ARRANGEMENT (μm) | SHIFTED AMOUNT OF DOTS ON THE PRINT MEDIUM (μm) |
|---|---|---|---|---|
| 1 | 0 | 0 | 0 | 0 |
| 2 | 6 | -7.92 | 7.92 | 0 |
| 3 | 12 | -15.84 | 15.84 | 0 |
| 4 | 3 | -3.96 | 3.96 | 0 |
| 5 | 9 | -11.88 | 11.88 | 0 |
| 6 | 15 | -19.8 | 19.8 | 0 |
| 7 | 2 | -2.64 | 2.64 | 0 |
| 8 | 8 | -10.56 | 10.56 | 0 |
| 9 | 14 | -18.48 | 18.48 | 0 |
| 10 | 5 | -6.6 | 6.6 | 0 |
| 11 | 11 | -14.52 | 14.52 | 0 |
| 12 | 1 | -1.32 | 1.32 | 0 |
| 13 | 7 | -9.24 | 9.24 | 0 |
| 14 | 13 | -17.16 | 17.16 | 0 |
| 15 | 4 | -5.28 | 5.28 | 0 |
| 16 | 10 | -13.2 | 13.2 | 0 |

FIG.13A

| NOZZLE | DRIVE SEQUENCE II | SHIFTED AMOUNT OF DOTS ON THE PRINT MEDIUM FOR A STRAIGHT LINE ARRANGEMENT (μm) | SHIFTED AMOUNT OF NOZZLES IN A SHIFTED NOZZLE ARRANGEMENT (μm) | SHIFTED AMOUNT OF DOTS ON THE PRINT MEDIUM (μm) |
|---|---|---|---|---|
| 1 | 15 | -19.8 | 0 | -19.8 |
| 2 | 9 | -11.88 | 7.92 | -3.96 |
| 3 | 3 | -3.96 | 15.84 | 11.88 |
| 4 | 12 | -15.84 | 3.96 | -11.88 |
| 5 | 6 | -7.92 | 11.88 | 3.96 |
| 6 | 0 | 0 | 19.8 | 19.8 |
| 7 | 13 | -17.16 | 2.64 | -14.52 |
| 8 | 7 | -9.24 | 10.56 | 1.32 |
| 9 | 1 | -1.32 | 18.48 | 17.16 |
| 10 | 10 | -13.2 | 6.6 | -6.6 |
| 11 | 4 | -5.28 | 14.52 | 9.24 |
| 12 | 14 | -18.48 | 1.32 | -17.16 |
| 13 | 8 | -10.56 | 9.24 | -1.32 |
| 14 | 2 | -2.64 | 17.16 | 14.52 |
| 15 | 11 | -14.52 | 5.28 | -9.24 |
| 16 | 5 | -6.6 | 13.2 | 6.6 |

FIG.13B

| NOZZLE | DRIVE SEQUENCE I | SHIFTED AMOUNT OF NOZZLES (μm) | SHIFTED AMOUNT OF DOTS ON THE PRINT MEDIUM (μm) |
|---|---|---|---|
| 1 | 0 | 0 | 0 |
| 2 | 6 | 0 | -7.92 |
| 3 | 12 | 0 | -15.84 |
| 4 | 3 | 0 | -3.96 |
| 5 | 9 | 0 | -11.88 |
| 6 | 15 | 0 | -19.8 |
| 7 | 2 | 0 | -2.64 |
| 8 | 8 | 0 | -10.56 |
| 9 | 14 | 0 | -18.48 |
| 10 | 5 | 0 | -6.6 |
| 11 | 11 | 0 | -14.52 |
| 12 | 1 | 0 | -1.32 |
| 13 | 7 | 0 | -9.24 |
| 14 | 13 | 0 | -17.16 |
| 15 | 4 | 0 | -5.28 |
| 16 | 10 | 0 | -13.2 |

FIG.16

PRINTING APPARATUS, PRINTING METHOD AND STORAGE MEDIUM

TECHNICAL FIELD

The present invention relates to a printing apparatus, a printing method and a storage medium. More particularly, the present invention relates to a printing apparatus that prints text or images onto a print medium by relatively moving a plurality of print heads, in which a plurality of time-share driven printing elements are arranged in an array, a printing method for that printing apparatus, and a non-transitory computer readable storage medium that stores a program.

BACKGROUND ART

A full-line type print head comprises a plurality of nozzles that are arranged and is fastened to the main head body so that the array direction of the nozzles coincides with the direction of the paper width. An inkjet printing apparatus such as illustrated in FIG. 1 is able to perform printing by conveying a print medium with the print head stationary, so high-speed printing is possible.

One kind of technology related to driving print heads is time-divisional driving of nozzles as disclosed in Patent Literature 1, for example. Time-divisional driving is performed in order to improve the speed of supplying ink and the stability of the ink supply, and in order to reduce the amount of peak power for driving the print heads.

FIGS. 2A to 2C are drawings for explaining an example of conventional time-divisional driving. In this example, the printing apparatus is such that a plurality of nozzles that are arranged in a row are divided into a plurality of nozzle groups with 16 nozzles in succession in each group, and each nozzle of these nozzle groups is driven at different timing. In the time-divisional driving of this example, nozzles that are driven at the same timing exist in every 16 nozzles.

FIG. 2A illustrates the relationship between a nozzle array and nozzle groups. FIG. 2B illustrates the timing for driving the continuous 16 nozzles, with the nozzle position in the array illustrated along the vertical axis, and the time illustrated along the horizontal axis. The 16 nozzles in a nozzle group, for example, from nozzle 1 to nozzle 16 are driven in order according to the timing of one cycle illustrated in FIG. 2B, and are similarly driven for each continuing cycle (not illustrated in the figure).

During one drive cycle, dots are formed in the same column on a print medium (area of one pixel width), however, the print medium is conveyed during driving, so dots are formed at shifted positions due to differences in the drive timing. Therefore, for printing data in a line perpendicular to the conveyance direction, dots are formed being shifted and distributed a maximum of one column width from the ideal dot position (see FIG. 2C). A dot distribution such as this that is formed on a print medium is disadvantageous in printing black text for which quality is required at the edge of an image.

As technology for solving this problem, there is technology that sets the nozzle positions of a print head to correspond with the conveyance speed and the drive timing during time-divisional driving. In the same way as illustrated in FIG. 2B, the 16 nozzles in a nozzle group are arranged so as to be shifted as illustrated in FIG. 3A to correspond to the shift in the drive timing during the time-divisional driving illustrated in FIG. 3B and conveyance speed. As illustrated in FIG. 3C, with this kind of technology, it is possible to cancel out the shifting between the ideal dot arrangement on a print medium and actual dot arrangement that is formed on a print medium.

CITATION LIST

Patent Literature

PTL1: Domestic Re-publication of WO/2001/053102

SUMMARY OF INVENTION

Technical Problem

However, in a full multi-type printing apparatus for color printing, for example, as illustrated in FIG. 1, there is a possibility that an inclination error θ with respect to a direction perpendicular to the conveyance direction among plurality of print heads will occur due to installation error of the print heads. In this case, a dot arrangement such as illustrated in FIG. 4A is printed on a print medium by a print head that does not have an inclination error θ. Moreover, a dot arrangement such as illustrated in FIG. 4B is printed on a print medium by a print head that has an inclination error θ. Therefore, when printing using both of these, there is a possibility that there will be sparse and dense areas in the distribution of dots on the print medium as illustrated in FIG. 4C, and that unevenness in the image will occur.

As was explained above, in conventional technology that avoids the scattering of dots by setting the nozzle positions, it is possible to improve the quality at the image edge, however, there is a problem in that the uniformity of an image decreases due to external factors such as inclination error between print heads.

The present invention can improve the quality at the image edge and maintain uniformity of an image when there is inclination error between print heads for a printing apparatus having a plurality of print heads in which a plurality of time-share driven printing elements are arranged.

Solution to Problem

In order to solve the problems described above, the present invention provides a printing apparatus comprising a plurality of print element arrays that comprise a plurality of printing elements that are arranged in arrays and that are used for discharging ink, the plurality of print element arrays being placed side by side in a direction cross to the direction of the arrays, a relative movement unit configured to cause the plurality of print element arrays and a print medium that faces the plurality of print element arrays to move relative to each other in the cross direction, a drive unit configured to drive the plurality of printing elements of the plurality of print element arrays by time-divisional driving in which the drive timing differs for each specified number of printing elements in a specified drive sequence, wherein the plurality of printing elements of a specified print element array from among the plurality of print element arrays that discharges a specified type of ink are arranged so as to take on relative displacement amounts in the cross direction according to a first drive sequence for the specified print element array in the time-divisional driving, the drive unit drives the plurality of printing elements of the specified print element array by the time-divisional driving to which the first drive sequence is applied so that dots are arranged in a linear shape based on image data that indicates a pixel array in the array direction that is formed in a specified area of a print medium, and the drive unit drives, by the time-divisional driving, the plurality of printing elements of a different print element array other than the specified print element array of the plurality of print element arrays are driven so that dots based on image data that indicates a pixel array in the array direction that is formed in the specified area are printed in positions displaced relative displacement amounts in the cross direction according to drive timing between the plurality of printing elements.

Moreover, the present invention provides a printing method comprising, a plurality of print element arrays that comprise a plurality of printing elements that are arranged in arrays and that are used for discharging ink, the plurality of print element arrays being placed side by side in a direction cross to the direction of the arrays, the printing method comprising the steps of, moving the plurality of print element arrays and a print medium that faces the plurality of print element arrays to each other in the cross direction, and driving the plurality of printing elements of the plurality of print element arrays by time-divisional driving in which the drive timing differs for each specified number of printing elements in a specified drive sequence, wherein the plurality of printing elements of a specified print element array from among the plurality of print element arrays that discharges a specified type of ink are arranged so as to take on relative displacement amounts in the cross direction according to a first drive sequence for the specified print element array in the time-divisional driving, by the step of driving, the plurality of printing elements of the specified print element array are driven by the time-divisional driving to which the first drive sequence is applied so that dots are arranged in a linear shape based on image data that indicates a pixel array in the array direction that is formed in a specified area of a print medium, and by the step of driving, the plurality of printing elements of a different print element array other than the specified print element array of the plurality of print element arrays are driven by the time-divisional driving so that dots based on image data that indicates a pixel array in the array direction that is formed in the specified area are printed in positions displaced relative displacement amounts in the cross direction according to drive timing between the plurality of printing elements.

Moreover, the present invention provides a non-transitory computer readable storage medium that has stored a program for causing a computer to function as the printing apparatus.

Advantageous Effects of Invention

With the present invention, in regard to dots that will be printed with ink having the highest density, displacement on the print medium in a direction corresponding to the printing element array direction due to time-divisional driving can be suppressed, so it is possible to improve quality of the edges of an image. On the other hand, in regard to dots of other ink, the dots are dispersed and arranged by displacing each of the dots on the print medium by a displacement amount in a direction that corresponds to the printing element array direction. Therefore, it is possible to achieve both an improvement of quality of the edges of an image, and maintain uniformity of an image with respect to the occurrence of inclination error between print heads.

Further features of the present invention will become apparent from the following description of exemplary embodiments (with reference to the attached drawings).

BRIEF DESCRIPTION OF DRAWINGS

FIG. 13A explains printing of dot arrays in a first embodiment;

FIG. 13B explains printing of dot arrays in a first embodiment;

FIG. 16 explains printing of color dot arrays other than black in a second embodiment.

DESCRIPTION OF EMBODIMENTS

Embodiments of the present invention will be explained with reference to the drawings.

Embodiment 1

The embodiment described below is an example in which the present invention is applied to an inkjet printing apparatus. In the inkjet printing apparatus of this embodiment, inkjet print heads are mounted in which an electric heat converter generates thermal energy, the thermal energy causes a film of ink to boil, and ink is discharged from nozzles by the pressure of ink bubbles that are generated as a result. The purpose of using this kind of ink discharge method is just for an example. The range of the present invention is not limited by this ink discharge method. As long as it is within the range disclosed in the Claims, it is possible to apply the present invention to printing apparatuses in which print heads using other various methods are mounted. For example, the present invention can also be applied to printing apparatuses in which print heads that use piezoelectric elements are mounted.

(Construction of the Apparatus)

First, the construction of an inkjet printing apparatus to which the present invention can be applied will be explained.

(Mechanical Construction)

Figure 1:
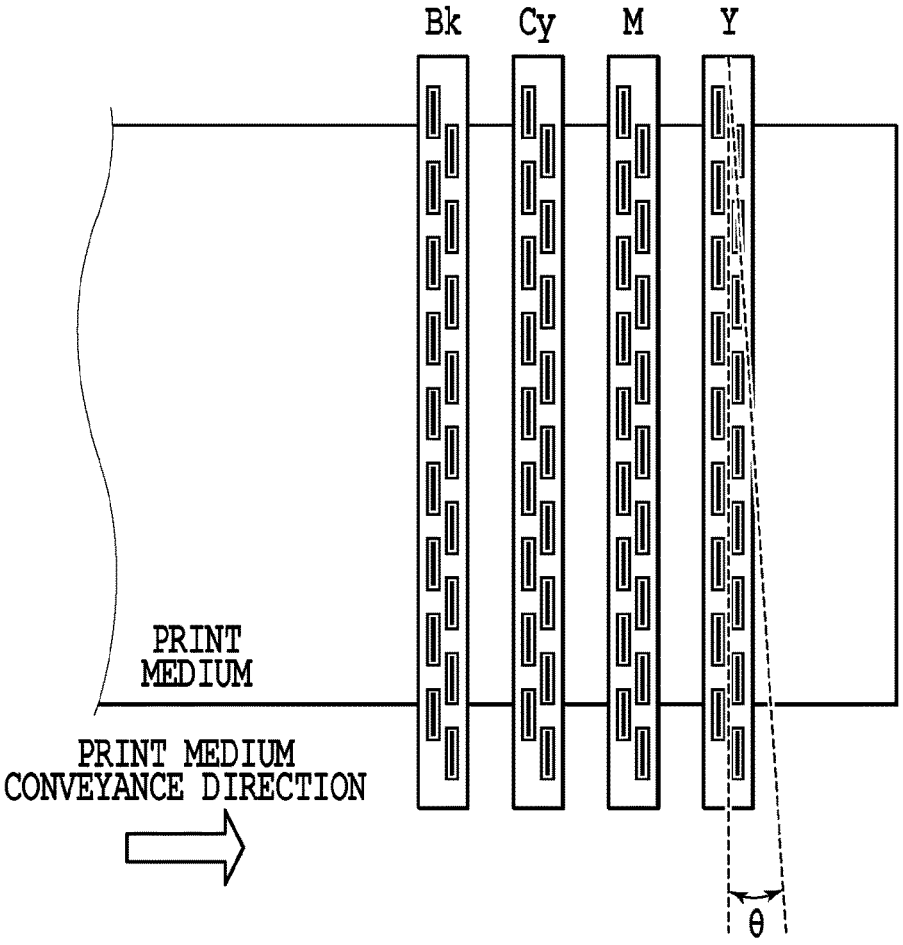
FIG. 1 illustrates the relationship between a print head and print medium in an inkjet printing apparatus to which the present invention is applied.
Figure 2A:
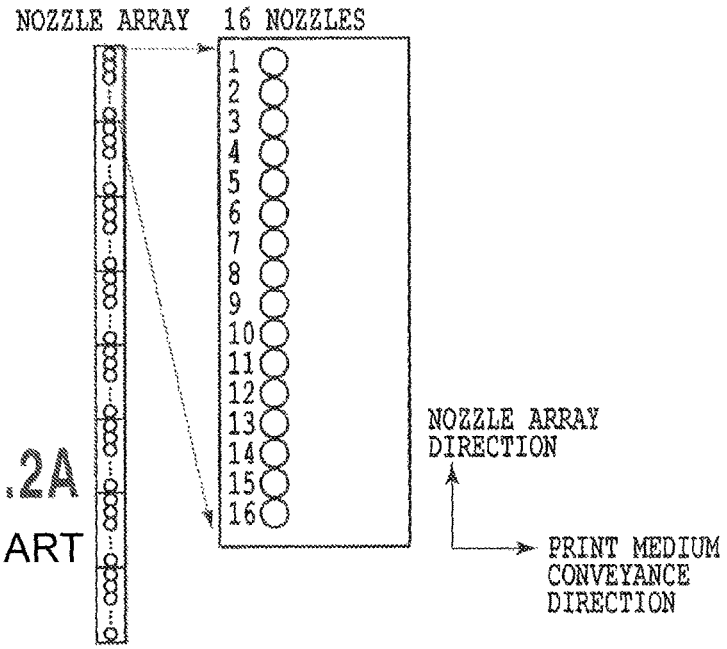
FIG.2A PRIOR ART
FIG. 2A explains an example of time-divisional driving and a dot arrangement on a print medium in a conventional print head.
Figure 2B:
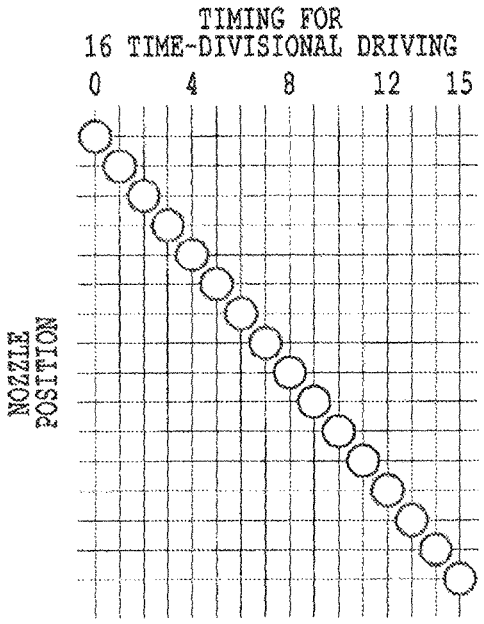
FIG.2B PRIOR ART
FIG. 2B explains an example of time-divisional driving and a dot arrangement on a print medium in a conventional print head.
Figure 2C:
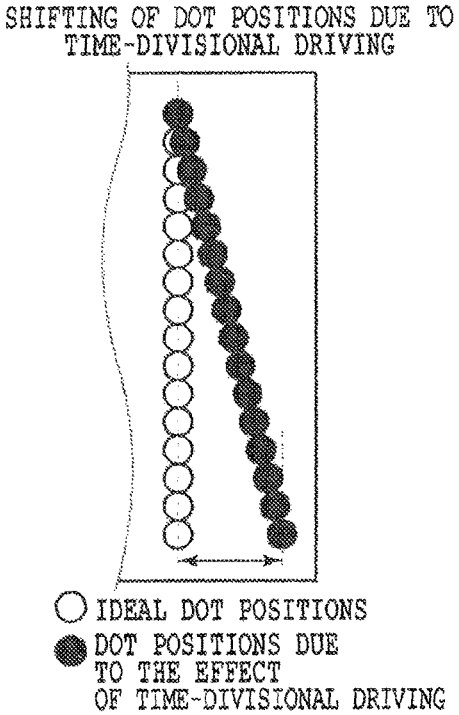
FIG.2C PRIOR ART
FIG. 2C explains an example of time-divisional driving and a dot arrangement on a print medium in a conventional print head.
Figure 3A:
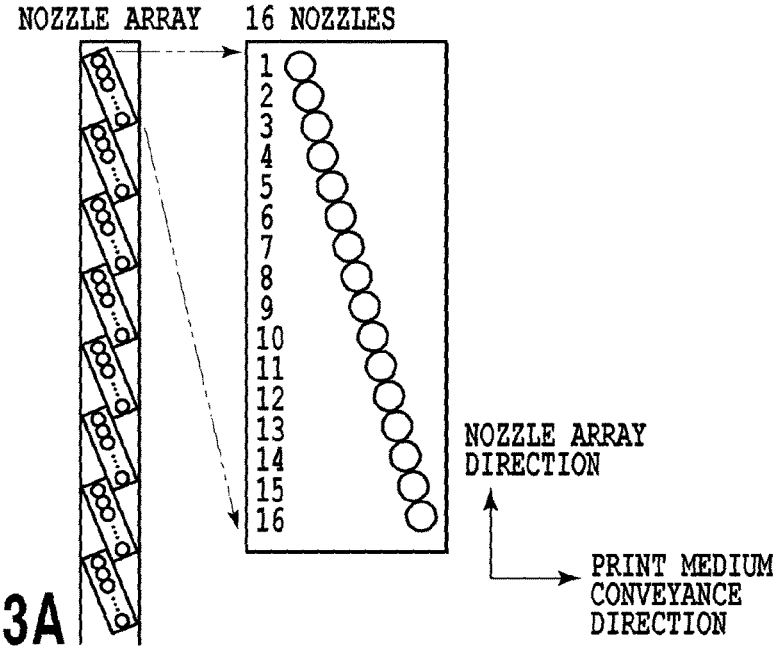
FIG.3A PRIOR ART
FIG. 3A explains another example of time-divisional driving and a dot arrangement on a print medium in a conventional print head.
Figure 3B:
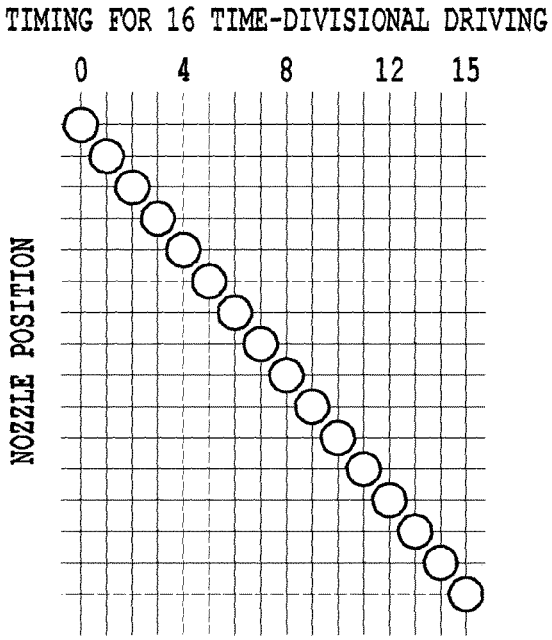
FIG.3B PRIOR ART
FIG. 3B explains another example of time-divisional driving and a dot arrangement on a print medium in a conventional print head.
Figure 3C:
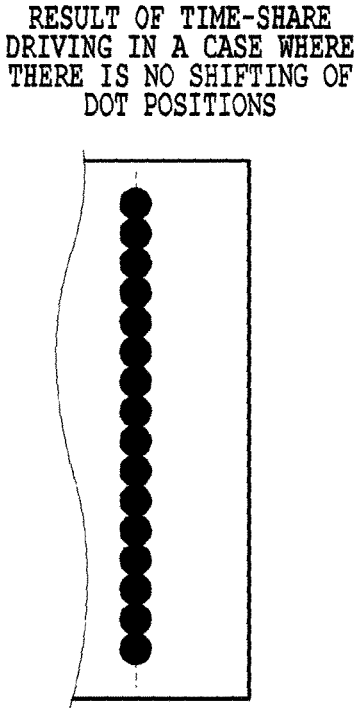
FIG.3C PRIOR ART
FIG. 3C explains another example of time-divisional driving and a dot arrangement on a print medium in a conventional print head.
Figure 4A:
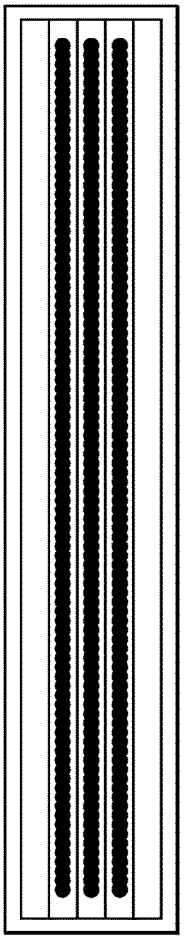
FIG.4A PRIOR ART
FIG. 4A explains dot arrangements on print medium that are printed by a conventional printing apparatus.
Figure 4B:
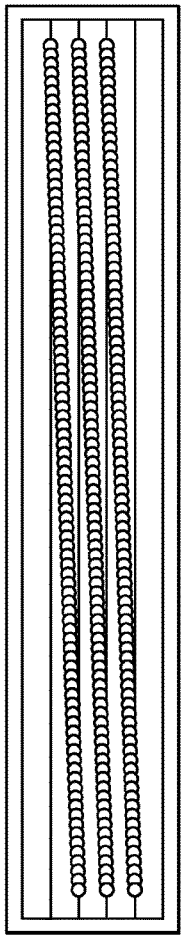
FIG.4B PRIOR ART
FIG. 4B explains dot arrangements on print medium that are printed by a conventional printing apparatus.
Figure 4C:
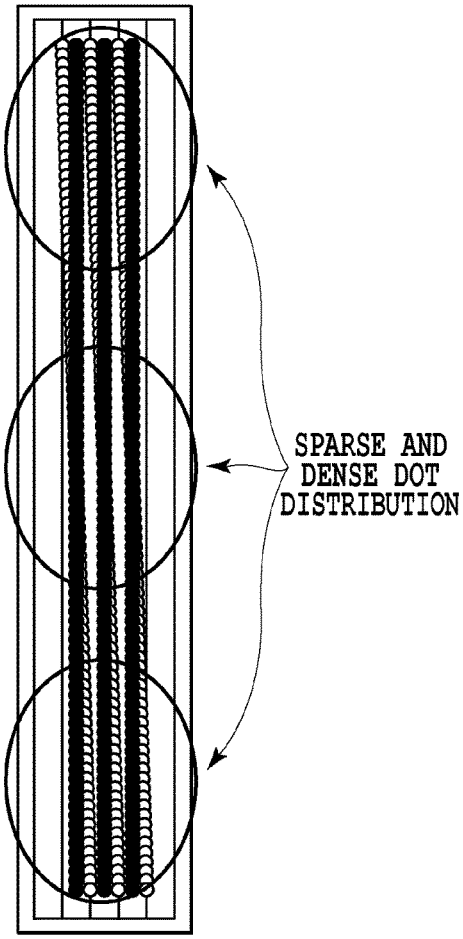
FIG.4C PRIOR ART
FIG. 4C explains dot arrangements on print medium that are printed by a conventional printing apparatus.
Figure 5:
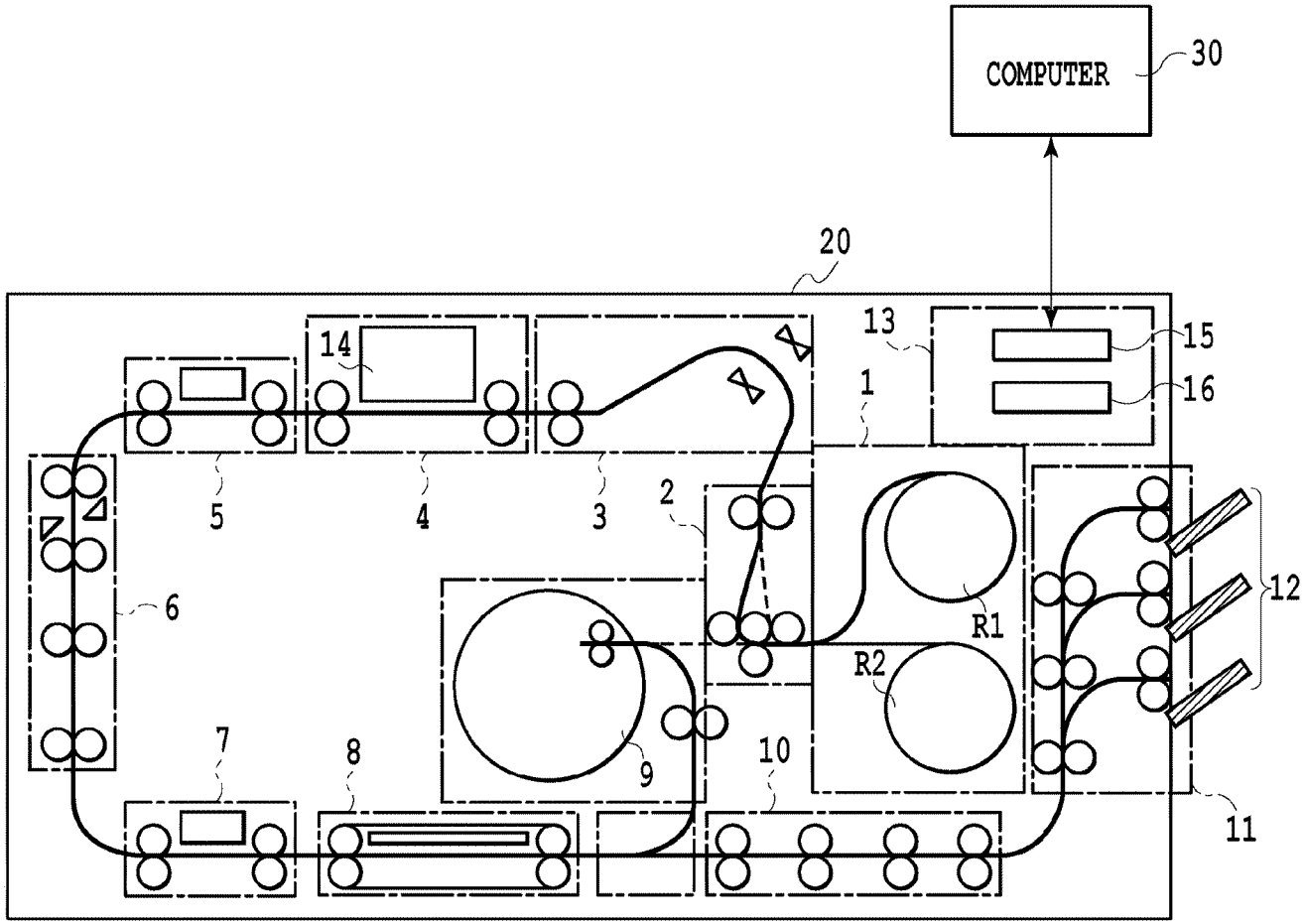
FIG. 5 illustrates a printing system that includes an inkjet printing apparatus to which the present invention can be applied.

FIG. 5 illustrates a printing system that includes a printing apparatus to which the present invention can be applied. This printing system, for example is constructed so that an inkjet printing apparatus 20 that is capable of printing on a sheet print medium that is rolled up into a roll shape, and an image-data supply device are connected. As the image-data supply device it is possible to use a personal computer (hereafter, simply referred to as a "computer") 30 that supplies image data to the printing apparatus 20.

The computer 30 has a function of supplying image data to the printing apparatus 20. The computer 30 comprises a main control device such as a CPU, ROM (Read Only Memory), RAM (Random Access Memory), and a storage device such as a HDD (Hard Disk Drive). In addition, the computer 30 comprises input/output devices such as a keyboard and a mouse; a communication device such as a network card; and the like. These components are connected by a bus or the like, and the functions above can be achieved by the main control device executing a computer program that is stored in the storage device.

As illustrated in FIG. 5, the printing apparatus 20 comprises a printer 4, a control unit 13 and the like. The printer 4 includes print heads 14 that actually print on a print medium. The control unit 13 includes a controller 15 that receives and processes image data from the computer 30, and an electric power source 16 that controls the electric power that is supplied to each component inside the printing apparatus 20. Moreover, the printing apparatus 20 comprises a sheet supplier 1, a decurler 2, a skew corrector 3, a scanner 5, a cutter 6, an information printer 7, a drier 8, a sheet winder 9, a discharge conveyor 10, a sorter 11, discharge trays 12 and the like; and these support the operation of the printing apparatus 20.

A sheet is conveyed along a conveyance path (path illustrated by the solid line in FIG. 5) by a conveying mechanism that comprises pairs of rollers and belts. The sheet supplier 1 stores a sheet that is rolled up into a roll shape. The decurler 2 reduces the curve in the sheet that is supplied from the sheet supplier 1. The skew corrector 3 corrects the skew of the sheet when the passing sheet is inclined with respect to the original advancing direction. The printer 4 prints an image on the sheet that is conveyed. The printer 4 comprises a plurality of inkjet print heads 14 (hereafter, simply referred to as "print heads 14"). Each of the print heads 14 of the printer 4 is a full-line type print head that has a printing width that corresponds to the maximum width of a sheet that is expected to be used.

The cutter 6 cuts the sheet to a specified length. The information printer 7 prints information such as a serial number and date on the rear surface of the sheet. The drier 8 heats the sheet and causes the ink on the sheet to dry. In the double-sided printing mode, the sheet winder 9 temporarily winds up a continuous sheet for which printing has been completed on one side. The discharge conveyor 10 conveys the sheet to the sorter 11. The sorter 11 sorts and discharges the sheets into different discharge trays 12. The control unit 13 controls all of the components of the printing apparatus 20. The control unit 13, for example, comprises a controller 15 that includes a CPU, memory (ROM, RAM), various I/O interfaces and the like, and an electric power source 16 that controls the electric power that is supplied to the components inside the printing apparatus 20.

The printing apparatus of this embodiment performs printing on a sheet that is rolled into a roll shape, however, clearly the present invention is not limited by the shape of the print medium being used. This is because the object of the present invention described above is accomplished by selectively applying the nozzle shift location and drive sequence in time-divisional driving as will be described later.

Moreover, the conveying mechanism of the printing apparatus of this embodiment is a typical roller mechanism, however, different conveying mechanisms do not hinder the effect of the present invention, and the present invention is not limited by the conveying mechanism.

(Construction of the Print Heads)

Figure 6:
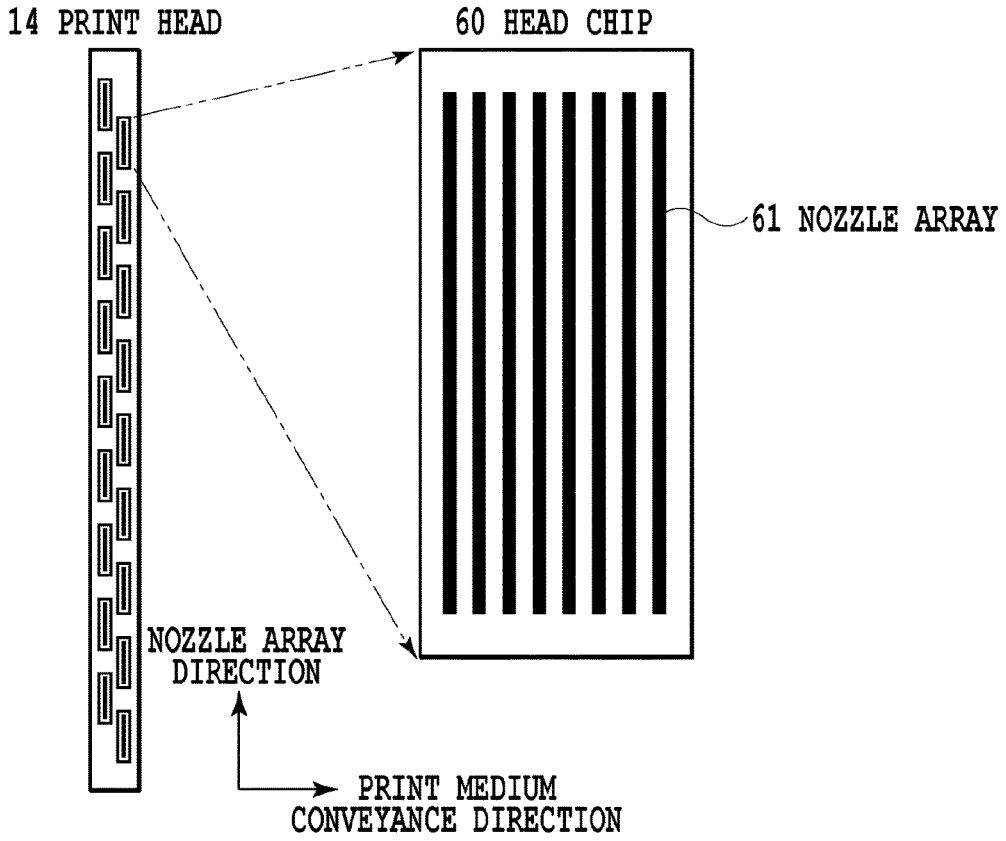
FIG. 6 is a schematic diagram of a print head of an embodiment.

The print heads 14 of the printer 4 are separate print heads 14 for the four colors cyan (C), magenta (M), yellow (Y) and black (K), and are constructed so as to be arranged side by side approximately perpendicular to the nozzle array direction. Each of the print heads 14 is arranged so as to face the print medium that is relatively conveyed along the conveyance path with respect to the print heads 14, and the construction of each is the same and illustrated in FIG. 6.

Eighteen head chips 60 that are made of silicon are attached to a print head 14 in a zigzag arrangement on a baseboard so as to cover the nozzle array direction and conveyance direction of the print medium. The effective discharge width of a head chip 60 is approximately 1 inch in length. The end sections of head chips that contribute to printing in adjacent areas form connecting sections that overlap in a direction that crosses the nozzle array direction. The head chips 60 are electrically connected by a flexible wiring board (not illustrated in the figure) and wire bonding at electrodes (not illustrated in the figure) on both ends in the nozzle array direction.

The print heads 14 comprise a non-volatile memory (ROM to be described later). The non-volatile memory is connected to the flexible wiring board in the same way as the head chips 60. The print heads 14 are liquid-discharging heads having an effective discharge width of approximately 18 inches, and can continuously print in one pass. The printer 4 comprises a print head 14 for each of the colors cyan (C), magenta (M), yellow (Y) and black (K), and can print in full color on a sheet.

A plurality of nozzle arrays 61, in which a plurality of nozzles that function as printing elements are arranged in a straight row, are arranged in each head chip 60. The print heads 14 of this embodiment, as an example, are constructed with 8 rows of nozzle arrays 61 per one head chip. Each nozzle, as an example that does not limit the present invention, is provided with a drive element that comprises a heating resistor element (heater) and a protective film that protects the heating resistor element. In addition, each nozzle is provided with a discharge port at a position facing the heating resister element, and a drop of ink is discharged outside from the discharge port. The drive element causes electric current to flow to the heater, which heats the liquid and generates bubbles, and that kinetic energy causes the liquid to be discharged from the nozzle. The number of nozzles in each nozzle array in this embodiment is 1024. The arrangement of the nozzles in each nozzle array will be described in detail later.

In this embodiment, a printing system that includes an inkjet printer having the most common construction and that performs color printing using four colors of ink C, M, Y and K will be explained. However, in consideration of the object of the present invention described above, the present invention of course is not limited to a 4-color inkjet printer. In other words, it is possible to apply the present invention to a printer that has print heads 14 that correspond to other colors in addition to the four colors CMYK, or to a printer that performs printing by combining ink types other than CMYK.

(Control Configuration)

Figure 7:
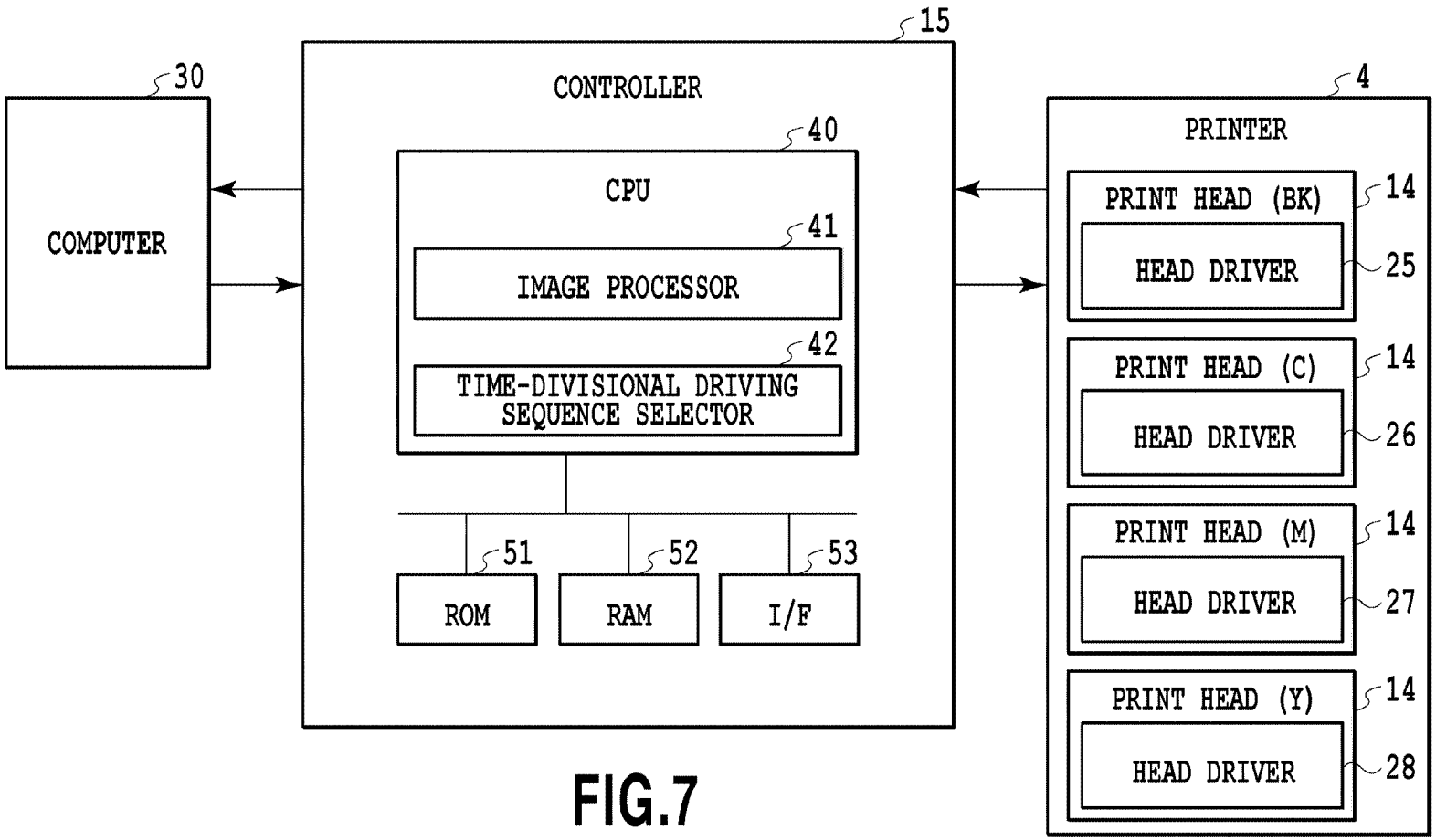
FIG. 7 is a schematic diagram of a controller and printer of an embodiment.

Next, an example of construction of the controller 15 will be explained using FIG. 7.

In the controller 15, a CPU 40 is connected to a ROM 51, RAM 52 and I/F 53 by way of a bus. The CPU 40 performs overall control of the processing by the printing apparatus 20. The ROM 51 stores a program for causing the printing apparatus 20 to operate, and information and the like for a plurality of drive sequences related to time-divisional driving that will be explained later. The RAM 52 is used as a work area for the CPU 40. The I/F 53 is a communication interface that connects external devices (for example, a computer 30) with the printing apparatus 20.

The CPU 40 comprises an image processor 41 and a time-share drive sequence selector 42 and the like, and executes the image processing by the printing apparatus 20 of this embodiment. This kind of image processing is achieved by the CPU 40 reading the program that is stored in the ROM 51, and executing that program using the RAM 52 as a work area.

The image processor 41 performs image processing on image data that was inputted in vector format, and generates a dot arrangement pattern for each head chip of the print heads 14 of each color, and for each nozzle array. The processing flow of the image processing by the image process 41 will be explained below with reference to FIG. 8.

Figure 8:
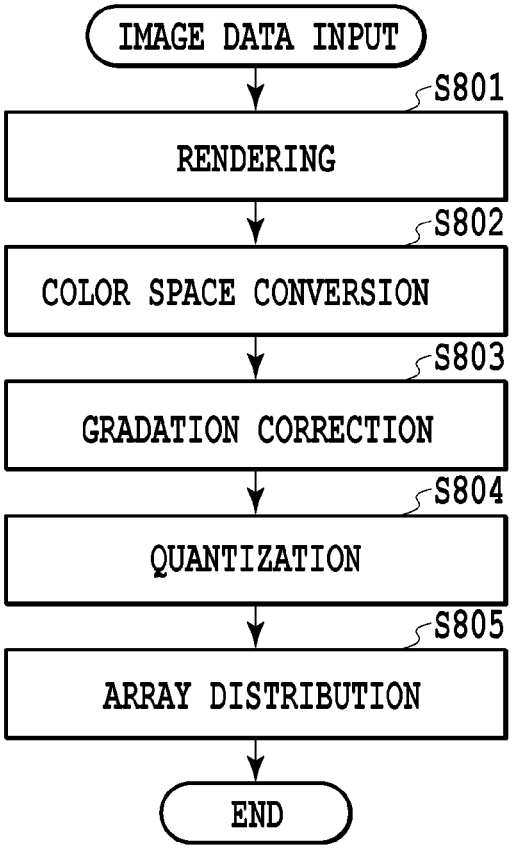
FIG. 8 is a flowchart illustrating an example of the image processing flow of an embodiment.

FIG. 8 illustrates the processing flow of the image processing that is performed by the image processor 41. First, in S801, the image processor 41 performs a rendering process on vector format image data that was received from the computer 30, and converts the vector format image data to bitmap format image data. In S802, the image processor 41 separates the image data that was converted to bitmap format into multi-value image data for each color of ink by a color space conversion process. The printing apparatus 20 of this embodiment comprises one print head 14 for each color CMYK, so the image processor 41 converts the image data that was converted to bitmap format to multi-value image data for each of the four colors. In a gradation correction process in S803, the image processor 41 performs gradation correction on the multi-value image data for each color. In a quantization process in S804, the image processor 41 converts ink dot number data for each color CMYK to data that indicates whether or not there is an ink dot using 1-bit data for each color CMYK. As the method for performing this, it is possible to use pseudo medium tone processing such as a dither matrix method or an error diffusion method, and it is also possible to use simple quantization according to the use of the output image. In this embodiment, multi-value image data of each color is converted to low gradation 16-value image data by an error diffusion method. The image processor 41 then further performs bina-rization processing on each of the 16 gradations of this 16-value image data to convert the image data to 1200 dpi×1200 dpi binary image data. In an array distribution process in S805, the image processor 41 distributes the 1200 dpi×1200 dpi binary image data to nozzle arrays of each head chip, and generates 1200 dpi×1200 dpi binary image data for each nozzle array.

According to the processing flow such as illustrated in FIG. 8, the inputted image data is converted to binary data that can be printed by the printing apparatus 20, and the printable binary image data is transferred to the printer 4.

In the processing flow in FIG. 8, a distribution process of image data at the connection between head chips was omitted, however, that data distribution process can be performed after the array distribution process. As that method, an image data distribution method between head chips by a gradation mask or the like is possible. However, the effect of an image data distribution method on the effect of the present invention is small, so the present invention is not limited to this image data distribution method.

The time-share drive sequence selector 42, according to the ink colors filled in each print head 14, selects a specific drive sequence from a plurality of drive sequences that are stored in the ROM 51. Next, the time-share drive sequence selector 42 transfers the selected drive sequence and binary image data to each print head 14. This will be described in detail later.

(Internal Construction and Control of a Print Head)

How the head drivers 25 to 28 of the print heads 14 cause ink to be discharged from nozzles based on binary image data will be explained in detail. The following explanation corresponds to all of the print heads 14 of the printing apparatus 20.

In this embodiment, the print heads 14 perform time-divisional driving of nozzles. As was described above, time-divisional driving is technology that reduces the burden on the electric power source by reducing the peak value of the drive current in the print heads 14. In this embodiment, in each head chip 60, 1024 nozzles are included in one nozzle array 61, and those 1024 nozzles are divided into nozzle groups every 16 continuous nozzles. The print heads 14 cause ink to be discharged by driving the nozzles in each nozzle group in order at different timing. As a result, the peak value of electric current that is necessary for discharging ink can be reduced by 1/16 when compared with the case of driving the nozzles of a head chip 60 at the same timing.

Figure 9:
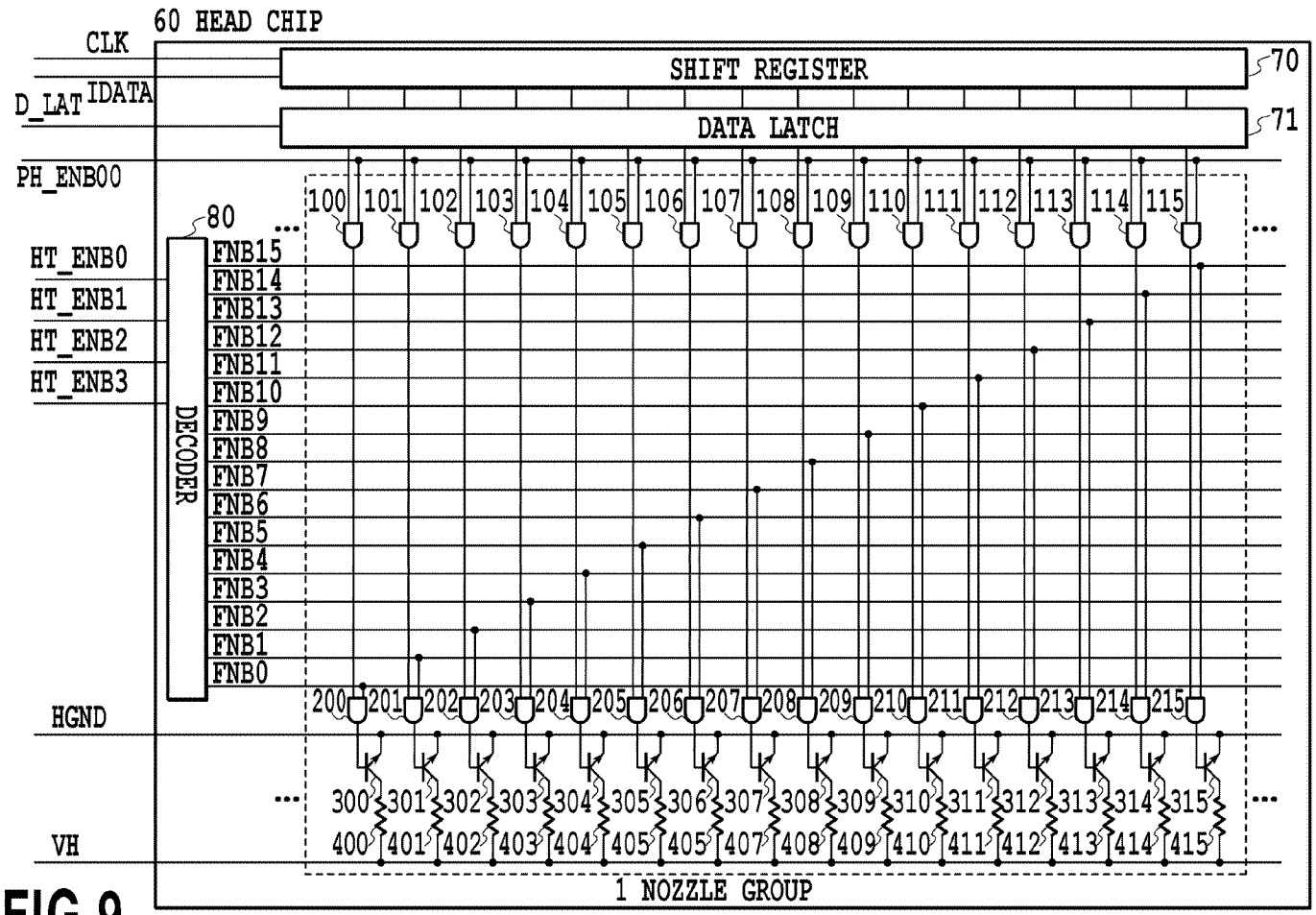
FIG. 9 is part of a circuit diagram that schematically illustrates an internal circuit of a print head of an embodiment.

FIG. 9 is part of a circuit diagram that schematically illustrates the internal circuitry of a print head 14. FIG. 9 illustrates the circuit construction of a head chip 60 for performing 16-division time-divisional driving of one nozzle group. The circuit construction inside head chips 60 that correspond to the other nozzle groups is the same, so is omitted in the figure.

In FIG. 9, image data IDATA is inputted to a shift register 70. The output from the shift register 70 is latched according to a latch signal D_LAT from a data latch 71. The output from the data latch 71 undergoes an AND operation with a heat enable signal PH_ENB00 by AND circuits 100 to 115. The output terminals of the AND circuits 100 to 115 become 1 when both the heat enable signal PH_ENB00 and the image data IDATA are 1. The heat enable signal PH_ENB00 is an enable signal for heating the head chip 0, and sets the heating time for each nozzle. In this embodiment, the same heat enable signal is connected to all of the nozzles in the head chip, and the heat time during discharge for each nozzle inside the head chip is the same.

The output of each AND circuit 100 to 115 is inputted to one of the input terminals of each AND circuit 200 to 215, and the output of each AND circuit 200 to 215 is connected to the base of each transistor 300 to 315. Each output terminal of a decoder 80 is connected to the other input terminal of each AND circuit 200 to 215. The output signals ENB0 to 15 that are generated by the decoder 80 based on signals HT_ENB0 to 3 are signals for making the drive timing in time-divisional driving described above different. The emitters of the transistors 300 to 315 are connected to a heat ground HGND, each of the collectors is connected to one terminal of each heater 400 to 415 that corresponds to each of the nozzles, and the other terminal of each heater 400 to 415 is connected to a heat electric power source VH.

In this kind of circuit construction, when the image data IDATA is "1" and the heat enable signal PH_ENB00 is "1", and furthermore when one of the output signals ENB0 to 15 is "1", one of the outputs of the AND circuits 200 to 215 becomes "1". One corresponding transistor among the transistors 300 to 315 becomes ON according to the outputs from the AND circuits 200 to 215. As a result, electric current flows to one corresponding heater among the heaters 400 to 415, and that heater generates heat, and ink is discharged from the corresponding nozzles.

Figure 10:
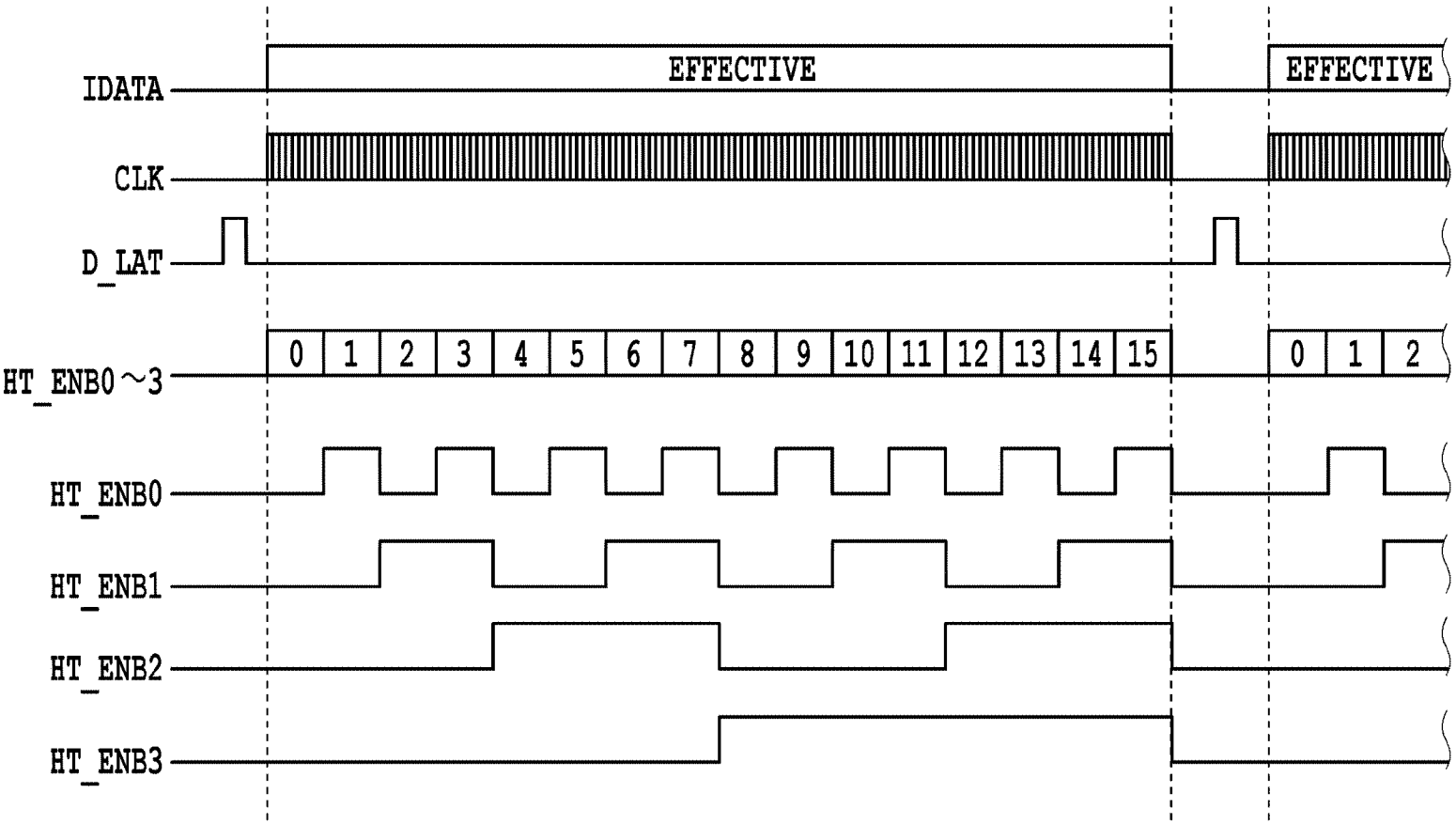
FIG. 10 is a timing chart of various signals that are transferred to the print head of an embodiment.

Next, the generation of the output signals ENB0 to 15 described above, which are signals for performing time-divisional driving, and the timing thereof will be explained. FIG. 10 is a timing chart that illustrates the timing of the various signals that are transferred to the print head 14.

Image data DATA in column units that is transferred to the print heads becomes effective by a latch signal D_LAT. Signals HT_ENB0 to 3 are expressed by 4-bit data with HT_ENB3 being the most significant bit. Signals HT_EN0 to 3 are transferred to the print head 14 as drive sequence information such as 0, 6, 12, 3, 9, 15, 2, 8, 14, 5, 11, 1, 7, 13, 4, 10 and the like in one column. The print head 14 is such that, depending on the combination of bits of the received signals HT_ENB0 to 3, the decoder 80 generates output signals ENB0 to 15 at timing that corresponds to drive sequence I and drive sequence II, or some other drive sequence, which is the time-share drive sequence that will be described later. In the decoder 80, for example, the output signals ENB0, 6, 12, 3, 9, 15, 2, 8, 14, 5, 11, 1, 7, 13, 4, 10 sequentially become 1 (active) at set intervals according to the timing chart, and the 16 nozzles are driven in order according to this (drive sequence I). In the same drive sequence that the 16 nozzles are time-share driven, each of the nozzles in 64 blocks of one nozzle array, 512 blocks in one head chip 1, and 9216 blocks in the print heads 14 of each color are time-share driven at the same time. Nozzles are time-divisionally driven in a similar way for the next column as well.

Next, selective application of driving order in time-divisional driving applied to an inkjet printing apparatus will be explained.

(Selective Application of Driving Order in Time-Divisional Driving)

In this embodiment, print heads that employ a shifted nozzle arrangement as will be explained later are used as the print heads 14 corresponding to each color. One drive sequence is selected from among at least two kinds of drive sequences according to the processing flow illustrated in FIG. 11 and the ink color that is to be discharged, and the selected drive sequence is applied to the ink color to be discharged.

Figure 11:
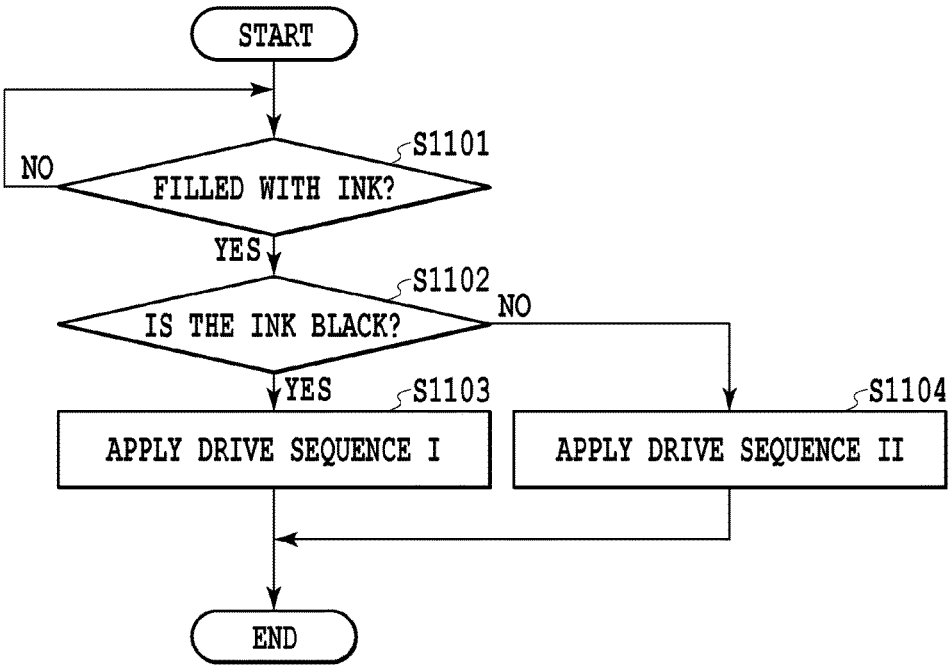
FIG. 11 is a flowchart illustrating the processing flow for selecting the drive sequence for time-divisional driving for each print head in a first embodiment.

When the power to the printing apparatus 20 is turned ON, the processing illustrated in FIG. 11 is performed for the print heads 14 of each color. In S1101 in a case where it is determined that ink is filled in the print heads 14 (S1101: YES), processing moves to step S1102. In a case where it is determined that ink is not filled in the print heads 14 (S1101: NO), step S1101 is performed again. In S1102, in a case where it is determined whether or not the ink color is black (Bk), and depending on the judgment result, drive sequence I or drive sequence II is selected and applied. In other words, for a print head 14 that is filled with black ink, processing branches to the processing of step S1103 and drive sequence I is applied, and for print heads 14 that are filled with a color other than black, processing branches to step S1104, and drive sequence II is applied.

(Time-Divisional Driving and Shifted Nozzle Arrangement of the Black Print Head)

As was explained above, when performing time-divisional driving of print heads that have straight nozzle arrays that are perpendicular to the conveyance direction, the dot positions in one column on the print medium are shifted by an amount equal to difference in the timing for driving each nozzle in time-divisional driving. In other words, the dot positions are dispersed and displaced on the print medium in the conveyance direction of the print medium. When a printing apparatus prints black text on a print medium, there is a need for quality at the edge of the image being printed. Therefore, in order to prevent the phenomenon of the dispersion and displacement of dot positions in the conveyance direction of the print medium, in this embodiment, a print head for black ink is used in which the nozzle arrangement is displaced from the straight array to correspond to drive sequence I. In this specification, such an arrangement is called a shifted nozzle arrangement.

Figures 12A, 12B:
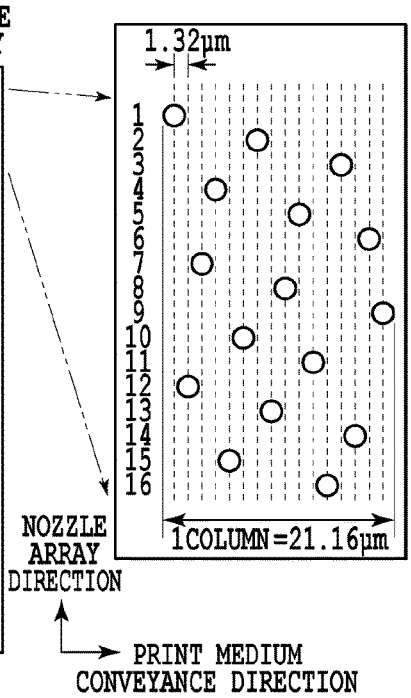
FIG. 12A explains time-divisional driving having different nozzle shifting locations and drive sequences in a first embodiment.
FIG. 12B explains time-divisional driving having different nozzle shifting locations and drive sequences in a first embodiment.

FIG. 12A illustrates drive sequence I that is applied to one nozzle group in a print head 14 for black ink, details about the shifted nozzle arrangement in drive sequence I, and the amount of nozzle shift of that shifted nozzle arrangement. FIG. 12A illustrates only one nozzle array of the eight nozzle arrays 61 in one head chip 60. Drive sequence I and the shifted nozzle arrangement are similarly applied to all of the nozzle arrays 61 of all of the head chips 60 in the print heads 14 of each color.

Each nozzle group in a nozzle array comprises 16 nozzles, and the timing for driving each nozzle of the 16 nozzles is different. In FIG. 12A, drive sequence I is set. In FIG. 12A and in the figures thereafter, the drive sequence is expressed from 0 to 15, and the nozzles are driven in order of smallest to largest number. Therefore, in drive sequence I, nozzle 1 is driven first and nozzle 12 is driven second. Continuing, each of the nozzles are driven in a repeating cycle in the order nozzle 7, nozzle 4, nozzle 15, nozzle 10, nozzle 2, nozzle 13, nozzle 8, nozzle 5, nozzle 16, nozzle 11, nozzle 3, nozzle 14, nozzle 9 and nozzle 6. As illustrated in FIG. 12A, the nozzle number is according to the array order. It should be understood that drive sequence I that is illustrated in FIG. 12A is just one example and does not limit the range of the present invention. In regards to the shifted nozzle arrangement and the specifications of the printing apparatus that will be explained below, it is also possible to set another arbitrary drive sequence that is able to arrange and print dots on the print medium in a direction that corresponds to the nozzle array direction. In that case, the shifted nozzle arrangement illustrated in FIG. 12A can be changed to correspond to that other drive sequence.

In the shifted nozzle arrangement of the example of this embodiment, the nozzles 1 to 16 are shifted and arranged as illustrated in FIG. 12A with respect to the perpendicular nozzle array direction (in other words, direction perpendicular to the conveyance direction of the print medium). The amounts of shifting of nozzles illustrated in FIG. 12A are based on the position in the conveyance direction of the print medium of nozzle 1 that is driven first according to drive sequence I, and an example is given of the nozzles 1 to 16 being arranged according to those amounts of shifting. The amounts of shifting of the nozzles can be calculated from the frequency of the drive signals for the print head, or from the difference in timing for driving between nozzles in time-divisional driving (in other words, the order the nozzles are driven), or from the sheet conveyance speed that sets the image resolution on the print medium in conjunction with these. In this embodiment, when the specifications of the printing apparatus 20 are set to a conveyance speed of 3 inches/sec, and 1200 dpi drive (the width of one pixel on the sheet is approximately 21.17 μm=25.4/1200 mm), it is presumed that drive sequence I for time-share drive number 16 is applied, and shifted nozzle arrangement is set. Therefore, the amount of shifting of each of the nozzles is an integer multiple of the value obtained by dividing one pixel width by the number of divisions 16. In a printing apparatus that has different specification than in this embodiment, a different shifted nozzle arrangement based on different shifting amounts can be applied, and it should be clear that the amounts of shifting illustrated in FIG. 12A do not limit the present invention.

Here, the operation that is achieved by cooperation between the shifted nozzle arrangement and drive sequence I will be explained with reference to FIGS. 13A, 13B and FIG. 14.

When a print head for black ink, in which shifted nozzle arrangement is not performed for the printing elements and nozzles are arranged in a straight array, performs time-divisional driving in which drive sequence I is applied, each of the printing elements is driven at set time intervals according to the timing chart for drive sequence I. As a result, the dots that are supposed to be printed on a print medium by the nozzles are shifted based on the dot position of the dot from nozzle 1 by distances that are given in the third column of the Table illustrated in FIG. 13A. The amounts of shifting in FIG. 13A and the following tables are such that shifting in the conveyance direction of the print medium is expressed as positive (+). Here, each amount of shifting is an integer multiple of the value obtained by dividing the distance that the print medium is conveyed during one time-share drive cycle by the number of divisions 16, and the amounts of shifting increase according to the drive sequence I.

On the other hand, in this embodiment, shifted nozzle arrangement is performed for the black ink print head, and the nozzles are arranged by shifting in the conveyance direction of the print medium by distances that are provided in the fourth column of the Table illustrated in FIG. 13A. As can be clearly seen from FIGS. 13A and 13B, the shifting amounts of the nozzles as described above are equal to the amounts of shifting (amounts of displacement) of the dots to be printed on the print medium according to drive sequence I for a print head in which the printing elements are arranged in a straight line, and the shifting direction is opposite to the direction of shifting of the dots to be printed. In this way, the shifted nozzle arrangement and the shifting of the dots to be printed are in a relationship that cancels each other out. Therefore, the dot arrangement on the print medium that is obtained by applying drive sequence I to the black ink print head having a shifted nozzle arrangement and by performing time-divisional driving is in a straight line in a direction that is cross to the conveyance direction. The dot arrangement on the print medium is illustrated in FIG. 14 as a black dot ink array 140. The black ink dot array 140 is such that shifting from the ideal dot arrangement on the medium is suppressed.

(Time-Divisional Driving and Shifted Nozzle Arrangement of Other Color Print Heads)

For print heads that discharge ink of colors other than black ink, shifted nozzle arrangement described above is set in common with the black print head. Moreover, as was described above, drive sequence II is applied for ink of colors other than black according to the processing in FIG. 11. In the following, drive sequence II will be explained in detail with reference to FIG. 12B.

FIG. 12B provides a comparison of drive sequence II that was set for other color print heads and drive sequence I. More specifically, in drive sequence I, the black ink print head 14 is driven in the order illustrated in FIG. 12A, and in drive sequence II, driving is performed in an order opposite to this. In other words, for other color print heads, the nozzles are driven in the order nozzle 6, nozzle 9, nozzle 14, nozzle 3, nozzle 11, nozzle 16, nozzle 5, nozzle 8, nozzle 13, nozzle 2, nozzle 10, nozzle 15, nozzle 4, nozzle 7, nozzle 12 and nozzle 1. In other words, for nozzles having the same nozzle numbers in the black print head and other color print heads, in the time-divisional driving of this embodiment having 16 divisions, the total added number of values in the drive sequence in drive sequence I and the values of the drive sequence in drive sequence II is one greater than 16, which is the number of the drive timing. For example, in drive sequence I, nozzle 4 is driven fourth, and in drive sequence II is driven thirteenth. Here, there is a correlation in that the added number of values in the drive sequences is 17, which is one more than 16, and this relationship also holds true for other nozzles as well. This kind of correlation between drive sequence I and drive sequence II also holds true for the case of time-divisional driving having 8 divisions, and the case of time-divisional driving having 32 divisions.

In drive sequence II for other color print heads, when printing is performed on a print medium by a print head for which shifted nozzle arrangement was performed for drive sequence I, there is a need for the impact positions of dots on the print medium to be shifted and dispersed uniformly in the conveyance direction with respect to the ideal dot arrangement. How drive sequence II satisfies this requirement will be explained with reference to FIGS. 13A and 13B and FIG. 14.

When drive sequence II is applied and time-divisional driving is performed for the black ink print head in which shifted nozzle arrangement is not performed for the printing elements and nozzles are arranged in a straight line, each of the printing elements is driven at set time intervals according to the timing chart. As a result, dots that are to be printed on the print medium by the nozzles are shifted by distances given in the third column of the Table illustrated in FIG. 13B based on the dot position of nozzle 6. In other words, with the dot position of dots from nozzle 6 as a reference, the amounts of displacement of the dots (shifting amounts) increase according to drive sequence II.

On the other hand, in this embodiment shifted nozzle arrangement described above is performed for print heads of other colors and the nozzles are arranged so as to be shifted in the conveyance direction of the print medium by distances given in the fourth column of the Table illustrated in FIG. 13B. Therefore, nozzle 6, which is driven first, for example, is shifted and located 19.8 μm in the conveyance direction of the print medium, so dot 142 is printed on the printed medium shifted 19.8 μm from the ideal dot position. Nozzle 9, which is driven second, when shifted nozzle arrangement is not performed is such that the dot to be printed is shifted 1.32 μm in the direction opposite the conveyance direction. However, by performing shifted nozzle arrangement, nozzle 9 is located at a position shifted 18.48 μm in the conveyance direction, so dot 143 is printed on the print medium at a position shifted 17.16 (=18.48−1.32)μm in the conveyance direction from the ideal dot position. In this way, dots 144 to 149 that are shifted in the conveyance direction are printed in sequence from nozzles 14, 3, 11, 16, 5 and 8. Next, dots 152 to 157 that are shifted in the direction opposite the conveyance direction are printed in sequence from nozzles 13, 2, 10, 15, 4, 7, 12 and 1. As can be clearly seen from the fifth column in FIG. 13B and FIG. 14, the dots are uniformly dispersed and arranged with each dot being shifted differing amounts in the conveyance direction or direction opposite the conveyance direction. This dot arrangement on the print medium is illustrated in FIG. 14 as dispersed dot array 141.

(Effect With Respect to a Conventional Example)

In this embodiment, it is possible to solve the problem with the conventional technology by selectively applying different drive sequences for time-divisional driving depending on the color of the ink of the print head by using print heads for each color that have head chips for which shifted nozzle arrangement has been performed to correspond to drive sequence I.

Figure 14:
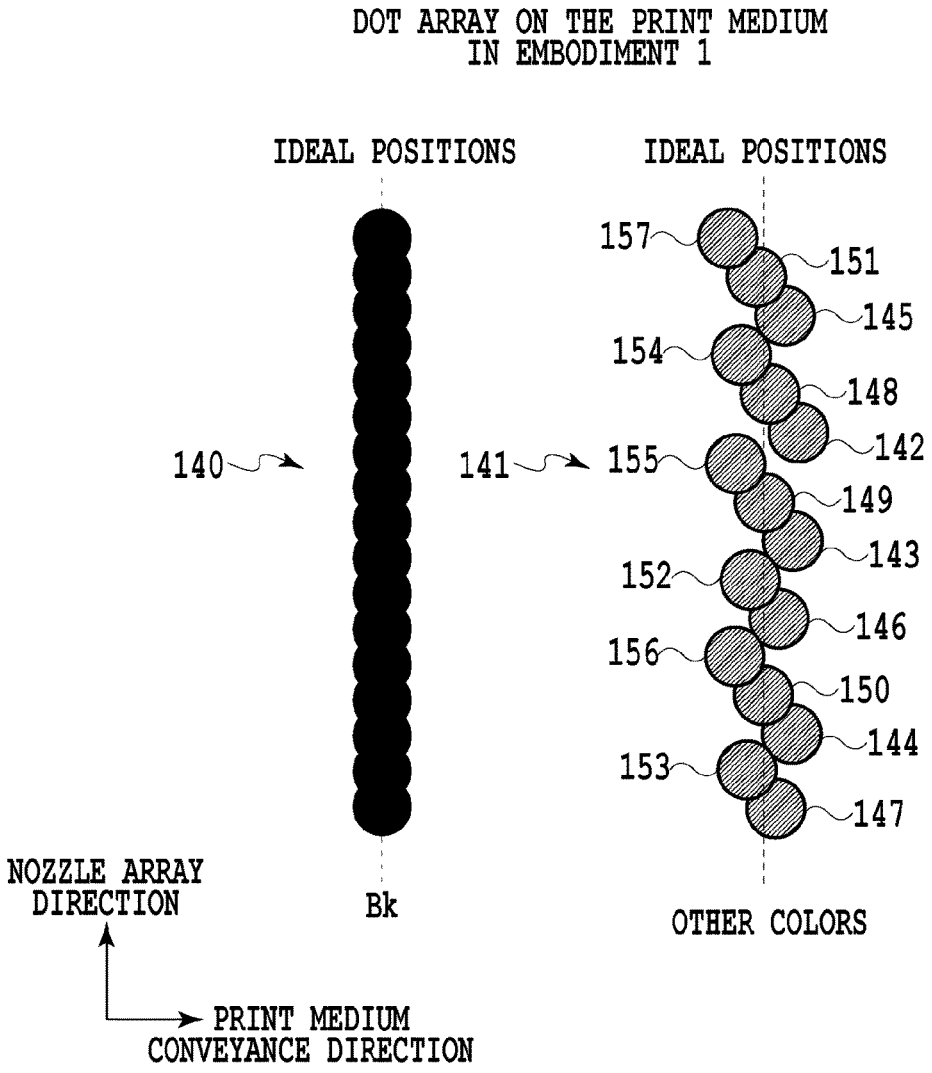
FIG. 14 illustrates two kinds of dot arrays in a first embodiment.

In other words, as illustrated in FIG. 14, it is possible to print an ideal dot array with no shifting of dots on a print medium by performing time-divisional driving to which drive sequence I is applied for a print head for black color ink Therefore, it is possible to improve the edge quality of a black image such as black text for which edge quality is particularly required.

Moreover, as illustrated in FIG. 14, it is possible to print a uniformly dispersed dot array on a print medium by performing time-divisional driving to which drive sequence II is applied for print heads of other colors because drive sequence II does not correspond to shifted nozzle arrangement. As a result, it is possible to prevent a decrease in the uniformity of an image due to external factors such as inclination error between print heads as occurred conventionally.

FIGS. 15A to 15E illustrate examples of dot arrays that are printed on a print medium in this embodiment when there is inclination error between print heads that have three nozzle arrays.

Figures 15A, 15B, 15C, 15D, 15E:
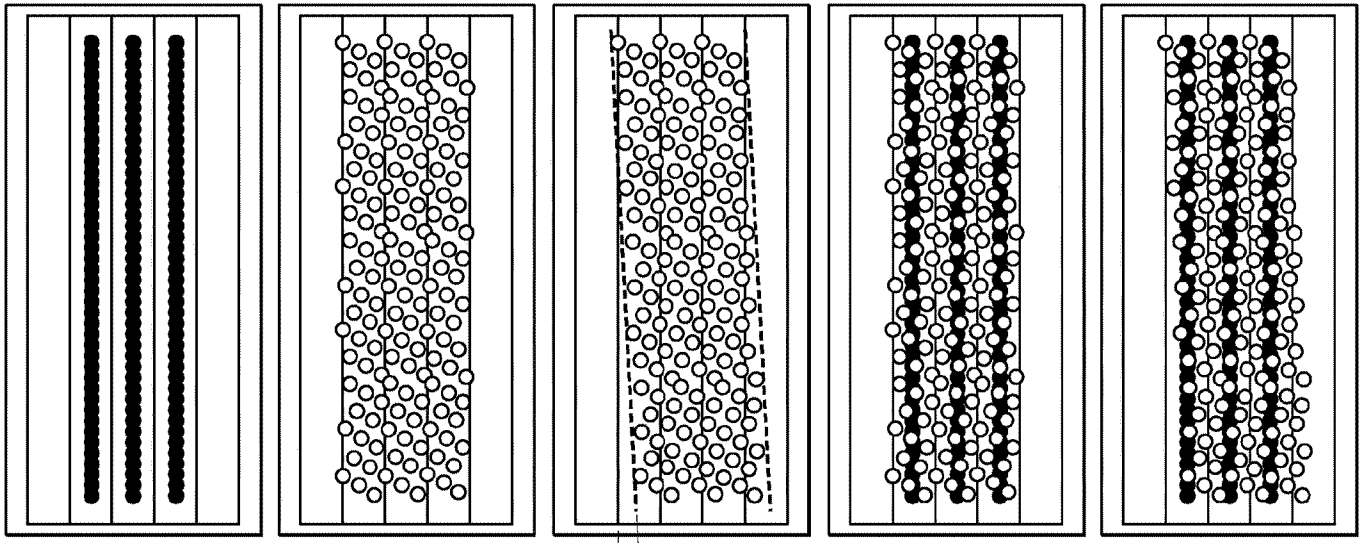
FIG. 15A explains the effect that is obtained when there is inclination error between print heads in a first embodiment.
FIG. 15B explains the effect that is obtained when there is inclination error between print heads in a first embodiment.
FIG. 15C explains the effect that is obtained when there is inclination error between print heads in a first embodiment.
FIG. 15D explains the effect that is obtained when there is inclination error between print heads in a first embodiment.
FIG. 15E explains the effect that is obtained when there is inclination error between print heads in a first embodiment.

FIG. 15A illustrates a dot array that is printed on a print medium by a print head that uses black ink when there is no nozzle inclination. FIG. 15B illustrates a dot array that is printed on a print medium by a print head that uses another color of ink when there is no nozzle inclination. As is illustrated in FIG. 15A and FIG. 15B, when a color image is printed by the print heads of each color, a dot array as illustrated in FIG. 15D is printed on the print medium by overlapping the dot arrays of both FIG. 15A and FIG. 15B.

On the other hand, when one or plurality of print heads that use ink of another color is installed having an inclination error θ, the dot array by this embodiment becomes as illustrated in FIG. 15C. Here, when a color image is printed on a print medium by print heads of each color, a dot array as illustrated in FIG. 15E is printed on the print medium based on the dot arrays of both FIG. 15A and FIG. 15C. In the dot array that is illustrated in FIG. 15E dots of colors other than black are finely dispersed and positioned on the print medium with respect to the inclination error θ, and it can be seen that because the cycle of dense and sparse dots is short, the unevenness in the image is difficult to notice. Therefore, it is possible to maintain uniformity in the image with respect to inclination error between print heads, and thus it is possible to improve the edge quality of a black image as described above, and keep uniformity of the image with respect to inclination error.

Furthermore, in addition to being able to achieve both effects, by using print heads that have the same standards for each color, there is also the effect of being advantageous from the aspect of cost, since there is no need to make special print heads for each color.

Embodiment 2

With this embodiment the same effect as in the first embodiment is obtained by performing time-divisional driving in which the same drive sequence is applied to the print heads of each color of ink.

In this embodiment, for the print head that discharges black ink, a print head having the shifted nozzle arrangement illustrated in FIG. 12A is used, and is driven by time-divisional driving to which drive sequence I is applied. The print heads that discharge other color ink are driven by time-divisional driving to which drive sequence I is applied the same as for the print head that discharges black ink, and print heads for which the nozzle arrangement that is different from the shifted nozzle arrangement in the first embodiment was performed are used. In this embodiment, in the nozzle arrangement for print heads of other colors, a plurality of nozzles are arranged in the nozzle array direction, or in other words, in a straight row that is perpendicular to the conveyance direction of the print medium.

Figure 17:
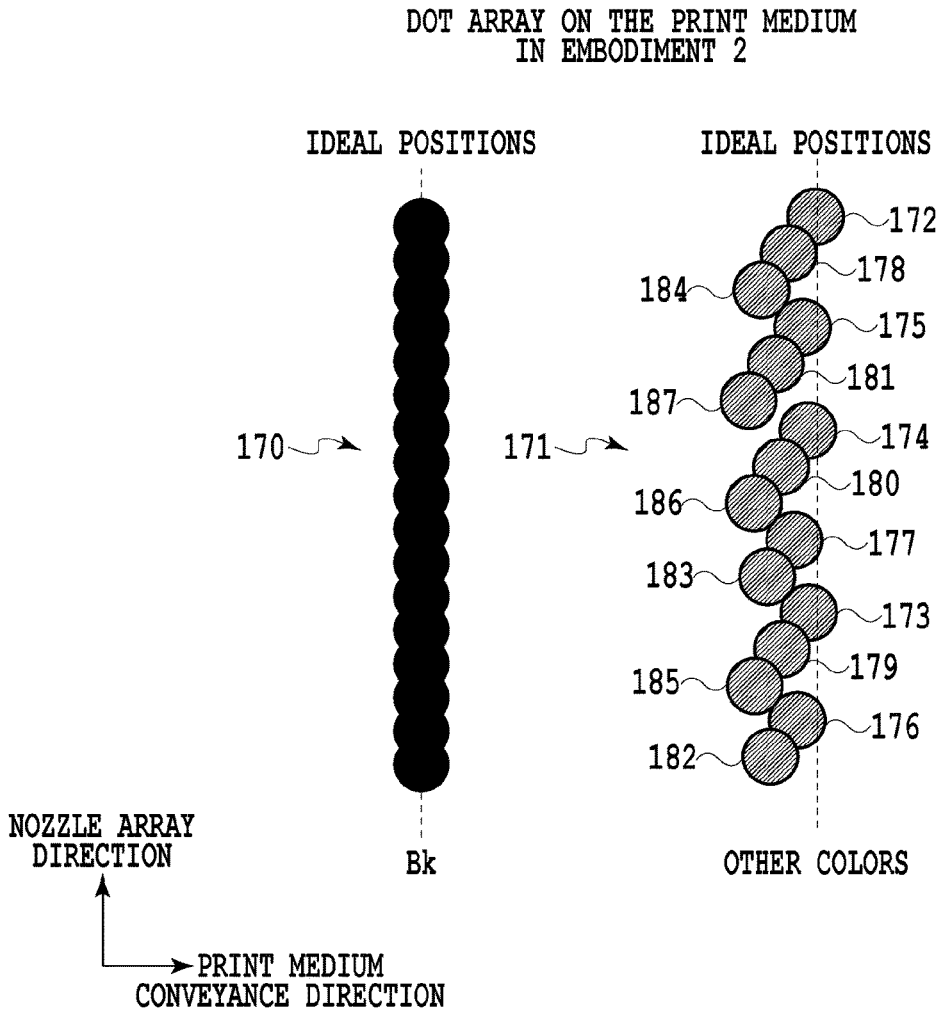
FIG. 17 illustrates two kinds of dot arrays in a second embodiment.

Here, the operation that is achieved by the nozzle arrangement and drive sequence I in this embodiment will be explained with reference to FIG. 16 and FIG. 17.

As illustrated in the third column of the Table in FIG. 16, the amounts of shifting of all of the nozzles are 0. When the print head for ink other than black ink and for which shifted nozzle arrangement is not performed performs time-divisional driving with drive sequence I applied, each of the printing elements is driven in drive sequence I at set time intervals according to the timing chart. As a result, the dots that are printed on the print medium are shifted by distances as given in the fourth column of the Table in FIG. 16 based on the dot position of the dot from nozzle 1. More specifically, in the case of nozzle 12 that is driven second after nozzle 1, the print medium is conveyed 1.32 μm between driving of nozzle 1 and driving of nozzle 12. Therefore, dot 173, which is shifted 1.32 μm in the opposite direction of the conveyance direction with respect to the dot printed by nozzle 1, is printed on the print medium. In this way, dots 172 to 187 are printed on the print medium being shifted by integer multiples of 1.32 μm in the opposite direction of the conveyance direction in sequence according to drive sequence I from nozzles 1, 12, 7, 4, 15, 10, 2, 13, 8, 5, 16, 11, 3, 14, 9 and 6. As illustrated in the fourth column of the Table in FIG. 16 and illustrated in FIG. 17, the dots are uniformly dispersed and positioned by being shifted different shifting amounts (displacement amounts) in the opposite direction from the conveyance direction of the print medium. This is illustrated in FIG. 17 by comparing the dispersed dot array 171 with the black ink dot array 170.

Furthermore, the black ink dot array 170 in this embodiment is arranged similar to the black ink dot array 140 of the first embodiment (see FIG. 14), and is the ideal dot arrangement with no shifting from the ideal dot positions on the print medium. Therefore, with this embodiment as well, except for the effect from the cost aspect, it is possible to obtain the same effects as in the first embodiment.

In each of the embodiments described above, the present invention was applied to an inkjet printing apparatus that comprises print heads for the colors black, yellow, cyan and magenta; however, the present invention can also be applied to various types of printing apparatuses that do not comprise a black print head. In that case, time-divisional driving to which drive sequence I is applied can be performed for the print head from among a plurality of print heads that discharge ink with the highest density and for which shifted nozzle arrangement has been performed in the same way as was done for the black print head in the embodiments described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-125509, filed Jun. 18, 2014, which is hereby incorporated by reference herein in its entirety.

The invention claimed is:

1. A printing apparatus comprising:

a plurality of print element arrays that comprise a plurality of printing elements that are arranged in arrays and that are used for discharging ink, the plurality of print element arrays being placed side by side in a direction crossing the direction of the print element arrays;

a relative movement unit configured to cause relative movement between the plurality of print element arrays and a print medium that faces the plurality of print element arrays in the crossing direction; and a drive unit configured to drive the plurality of printing elements of the plurality of print element arrays by time-divisional driving in which the drive timing differs for each specified number of printing elements in a specified drive sequence, wherein the plurality of printing elements of a specified print element array from among the plurality of print element arrays that discharges a specified type of ink are arranged so as to take on relative displacement amounts in the crossing direction according to a first drive sequence for the specified print element array in the time-divisional driving, the drive unit drives the plurality of printing elements of the specified print element array by the time-divisional driving to which the first drive sequence is applied so that dots are arranged in a linear shape based on image data that indicates a pixel array in the array direction that is formed in a specified area of a print medium, and the drive unit drives, by the time-divisional driving, the plurality of printing elements of a different print element array other than the specified print element array of the plurality of print element arrays so that dots based on image data that indicates a pixel array in the array direction that is formed in the specified area are printed in positions displaced by relative displacement amounts in the crossing direction according to drive timing between the plurality of printing elements.

2. The printing apparatus according to claim 1, wherein the plurality of printing elements of the different print element array are arranged so as to take on relative displacement amounts with respect to each other according to the first drive sequence, and the drive unit drives the plurality of printing elements of the different print element array by applying a second drive sequence that differs from the first drive sequence in the time-divisional driving.

3. The printing apparatus according to claim 2, wherein the second drive sequence is set so that the number obtained by adding the sequence order number in the first drive sequence and the sequence order number in the second drive sequence for each of the plurality of printing elements is one less than the number of the drive timing divisions in the time-divisional driving.

4. The printing apparatus according to claim 1, wherein the plurality of printing elements of the different print element array are arranged in a straight line, and the drive unit drives the plurality of printing elements of the different print element array by applying the first drive sequence in the time-divisional driving.

5. The printing apparatus according to claim 1, wherein the relative displacement amounts in the crossing direction according to the drive timing between the plurality of printing elements are set based on the drive sequence order numbers of each of the plurality of printing elements in the first drive sequence, and the image resolution in the direction of relative movement that is achieved on the print medium.

6. The printing apparatus according to claim 1, further comprising a plurality of print heads installed with each print element array from among the plurality of print element arrays.

7. The printing apparatus according to claim 1, wherein each print element array from among the plurality of print element arrays discharges different ink, respectively.

8. The printing apparatus according to claim 1, wherein the specified print element array and the different print element array discharge different ink, respectively.

9. The printing apparatus according to claim 8, wherein the specified print element array discharges ink having the highest density among the plurality of print element arrays.

10. The printing apparatus according to claim 9, further comprising a determination unit configured to determine whether to discharge ink having the highest density or to discharge other ink from the plurality of print element arrays.

11. The printing apparatus according to claim 9, wherein the ink having the highest density is black ink, and the specified print element array discharges the black ink.

12. The printing apparatus according to claim 1, wherein each of the plurality of printing elements has a discharge port and a thermal energy generating element for generating thermal energy for discharging ink from the discharge port, and the drive unit drives the plurality of printing elements by causing the corresponding thermal energy generating element to generate thermal energy.

13. The printing apparatus according to claim 1, wherein the relative movement unit conveys the print medium in the crossing direction of the plurality of print element arrays with the printing element arrays being stationary.

14. A printing method for use with a plurality of print element arrays that comprise a plurality of printing elements that are arranged in arrays and that are used for discharging ink, the plurality of print element arrays being placed side by side in a direction crossing the direction of the print element arrays, the printing method comprising the steps of:

causing relative movement between the plurality of print element arrays and a print medium that faces the plurality of print element arrays in the crossing direction; and driving the plurality of printing elements of the plurality of print element arrays by time-divisional driving in which the drive timing differs for each specified number of printing elements in a specified drive sequence; wherein the plurality of printing elements of a specified print element array from among the plurality of print element arrays that discharges a specified type of ink are arranged so as to take on relative displacement amounts in the crossing direction according to a first drive sequence for the specified print element array in the time-divisional driving, by the step of driving, the plurality of printing elements of the specified print element array are driven by the time-divisional driving to which the first drive sequence is applied so that dots are arranged in a linear shape based on image data that indicates a pixel array in the array direction that is formed in a specified area of a print medium, and by the step of driving, the plurality of printing elements of a different print element array other than the specified print element array of the plurality of print element arrays are driven by the time-divisional driving so that dots based on image data that indicates a pixel array in the array direction that is formed in the specified area are printed in positions displaced by relative displacement amounts in the crossing direction according to drive timing between the plurality of printing elements.

15. The printing method according to claim 14, wherein the plurality of printing elements of the different print element array are arranged so as to take on relative displacement amounts with respect to each other according to the first drive sequence, and by the step of driving, the plurality of printing elements of the different print element array are driven by applying a second drive sequence that differs from the first drive sequence in the time-divisional driving.

16. The printing method according to claim 15, wherein by the step of driving, the second drive sequence is set so that the number obtained by adding the sequence order number in the first drive sequence and the sequence order number in the second drive sequence for each of the plurality of printing elements is one less than the number of the drive timing divisions in the time-divisional driving.

17. The printing method according to claim 14, wherein the plurality of printing elements of the different print element array are arranged in a straight line, and by the step of driving, the plurality of printing elements of the different print element array are driven by applying the first drive sequence in the time-divisional driving.

18. The printing method according to claim 14, further comprising the step of:

setting the relative displacement amounts in the crossing direction according to the drive timing between the plurality of printing elements based on the drive sequence order numbers of each of the plurality of printing elements in the first drive sequence, and the image resolution in the direction of relative movement that is achieved on the print medium.

19. The printing method according to claim 14, wherein by the step of driving, the plurality of printing elements of each print element array installed in a plurality of print heads are driven.

20. The printing method according to claim 14, wherein by the step of driving, the plurality of printing elements of each print element array for discharging a different ink are driven.

21. The printing method according to claim 14, wherein by the step of driving, the plurality of printing elements of the specified print element array and the plurality of printing elements of the different print element array are driven, the specified print element array and the different print element array discharging different ink, respectively.

22. The printing method according to claim 21, wherein by the step of driving, the plurality of printing elements of the specified print element array are driven, the specified print element array discharging ink having the highest density among the plurality of print element arrays.

23. The printing method according to claim 22, further comprising the step of:

determining whether to discharge ink having the highest density or to discharge other ink from the plurality of print element arrays.

24. The printing method according to claim 22, wherein the ink having the highest density is black ink, and by the step of driving, the plurality of printing elements of the specified print element array are driven, the specified print element array discharging the black ink.

25. The printing method according to claim 14, wherein each of the plurality of printing elements has a discharge port and a thermal energy generating element for generating thermal energy for discharging ink from the discharge port, and by the step of driving, the plurality of printing elements are driven by causing the corresponding thermal energy generating element to generate thermal energy.

26. The printing method according to claim 14, wherein by the step of moving, the print medium is conveyed in the crossing direction of the plurality of print element arrays with the printing element arrays being stationary.

27. A non-transitory computer readable storage medium for storing a program for causing a computer to function as a printing apparatus, where the printing apparatus comprises:

a plurality of print element arrays that comprise a plurality of printing elements that are arranged in arrays and that are used for discharging ink, the plurality of print element arrays being placed side by side in a direction crossing the direction of the print element arrays;

a relative movement unit configured to cause relative movement between the plurality of print element arrays and a print medium that faces the plurality of print element arrays in the crossing direction; and a drive unit configured to drive the plurality of printing elements of the plurality of print element arrays by time-divisional driving in which the drive timing differs for each specified number of printing elements in a specified drive sequence, wherein the plurality of printing elements of a specified print element array from among the plurality of print element arrays that discharges a specified type of ink are arranged so as to take on relative displacement amounts in the crossing direction according to a first drive sequence for the specified print element array in the time-divisional driving, the drive unit drives the plurality of printing elements of the specified print element array by the time-divisional driving to which the first drive sequence is applied so that dots are arranged in a linear shape based on image data that indicates a pixel array in the array direction that is formed in a specified area of a print medium, and the drive unit drives, by the time-divisional driving, the plurality of printing elements of a different print element array other than the specified print element array of the plurality of print element arrays so that dots based on image data that indicates a pixel array in the array direction that is formed in the specified area are printed in positions displaced by relative displacement amounts in the crossing direction according to drive timing between the plurality of printing elements.

* * * * *